US010808993B2

(12) United States Patent
Joo et al.

(10) Patent No.: US 10,808,993 B2
(45) Date of Patent: Oct. 20, 2020

(54) REFRIGERATOR

(71) Applicant: SAMSUNG ELECTRONICS CO., LTD., Suwon-si, Gyeonggi-do (KR)

(72) Inventors: Sun Hwan Joo, Suwon-si (KR); Jong Sun Park, Gwangju (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 101 days.

(21) Appl. No.: 15/110,206

(22) PCT Filed: Jan. 7, 2015

(86) PCT No.: PCT/KR2015/000156
§ 371 (c)(1),
(2) Date: Jul. 7, 2016

(87) PCT Pub. No.: WO2015/105332
PCT Pub. Date: Jul. 16, 2015

(65) Prior Publication Data

US 2016/0334158 A1 Nov. 17, 2016

(30) Foreign Application Priority Data

Jan. 7, 2014 (KR) ..... 10-2014-0002067
Aug. 14, 2014 (KR) ..... 10-2014-0106067

(51) Int. Cl.
*F25D 29/00* (2006.01)
*F25C 5/20* (2018.01)
(Continued)

(52) U.S. Cl.
CPC ..... *F25D 29/005* (2013.01); *F25C 5/22* (2018.01); *F25D 23/028* (2013.01);
(Continued)

(58) Field of Classification Search
CPC ..... F25D 23/028; F25D 2400/361; F25D 2400/36; F25D 23/02; F25D 2327/00;
(Continued)

(56) References Cited

U.S. PATENT DOCUMENTS

2006/0145576 A1* 7/2006 Lee ..... F16M 11/2092 312/406
2008/0047287 A1* 2/2008 Ruppert ..... F25D 29/00 62/256
(Continued)

FOREIGN PATENT DOCUMENTS

CN 201126292 Y 10/2008
CN 201196521 2/2009
(Continued)

OTHER PUBLICATIONS

English Translation of CN101686618A.*
(Continued)

*Primary Examiner* — Marc E Norman
*Assistant Examiner* — Schyler S Sanks
(74) *Attorney, Agent, or Firm* — Staas & Halsey LLP

(57) ABSTRACT

Disclosed is a refrigerator. The refrigerator includes a main body; a storage room formed in the inside of the main body; a door including a front plate which is made of a steel material and in which a plurality of through holes forming a predetermined shape are formed, the door configured to open or close the storage room; a display unit disposed in the inside of the door, and including a display member in which a display element having a shape corresponding to the plurality of through holes and facing the plurality of through holes is formed; and an input member separated from the display unit, and configured to receive an operation command for operating the refrigerator.

13 Claims, 36 Drawing Sheets

(51) Int. Cl.
*F25D 23/02* (2006.01)
*F25D 23/12* (2006.01)
*F25D 25/02* (2006.01)

(52) U.S. Cl.
CPC ..... *F25D 23/126* (2013.01); *F25D 25/021* (2013.01); *F25D 2400/361* (2013.01)

(58) Field of Classification Search
CPC ..... F25D 2327/001; F25D 2400/18; F25D 29/005; F21V 33/004
See application file for complete search history.

(56) References Cited

U.S. PATENT DOCUMENTS

| | | | | |
|---|---|---|---|---|
| 2008/0289940 | A1* | 11/2008 | Kim | D06F 39/005 200/336 |
| 2010/0045617 | A1 | 2/2010 | Lee | |
| 2010/0156260 | A1* | 6/2010 | Arzoz Barandalla | F25D 23/028 312/405 |
| 2010/0320890 | A1* | 12/2010 | Jung | F25D 27/00 312/402 |
| 2011/0048047 | A1* | 3/2011 | Kim | F25D 29/005 62/246 |
| 2011/0096262 | A1* | 4/2011 | Kikuchi | G09F 9/35 349/58 |

FOREIGN PATENT DOCUMENTS

| | | | | |
|---|---|---|---|---|
| CN | 101535748 | | | 9/2009 |
| CN | 201348688 | Y | | 11/2009 |
| CN | 101686618 | A | * | 3/2010 |
| CN | 101939605 | | | 1/2011 |
| CN | 102472555 | | | 5/2012 |
| JP | 2011-58787 | | | 3/2011 |
| KR | 10-0634367 | | | 10/2006 |
| KR | 10-2009-0090518 | | | 8/2009 |
| KR | 10-2010-0137239 | A | | 12/2010 |
| KR | 10-2011-0101439 | | | 9/2011 |
| KR | 20110101439 | A | * | 9/2011 |
| KR | 10-2012-0015249 | | | 2/2012 |
| KR | 10-2013-0058085 | | | 6/2013 |
| WO | WO 2007/060188 | A2 | | 5/2007 |
| WO | WO 2007/060188 | A3 | | 5/2007 |
| WO | WO 2009/112499 | A1 | | 9/2009 |
| WO | WO 2013/020808 | A2 | | 2/2013 |
| WO | WO 2013/020808 | A3 | | 2/2013 |

OTHER PUBLICATIONS

English Translation of KR20110101439A.*
Extended European Search Report dated Dec. 14, 2016 in corresponding European Patent Application No. 15735128.9.
Australian Office Action dated Dec. 21, 2016 in corresponding Australian Patent Application No. 2015205139.
European Office Action dated Aug. 18, 2017 in corresponding European Patent Application No. 15735128.9.
Australian Notice of Acceptance for Patent Application dated Apr. 21, 2017, in corresponding Australian Patent Application No. 2015205139.
Canadian Search Report dated Apr. 5, 2017 in corresponding Canadian Patent Application No. 2,935,155.
Chinese Office Action dated Apr. 3, 2018 in Chinese Patent Application No. 201580012558.4.
Canadian Office Action dated Feb. 2, 2018 in Canadian Patent Application No. 2,935,155.
European Office Action dated Oct. 4, 2018 from European Patent Application No. 15735128.9, 6 pages.
Chinese Office Action dated Sep. 18, 2018 from Chinese Patent Application No. 2015800125584, 33 pages.
Canadian Office Action dated Oct. 10, 2018 from Canadian Patent Application No. 2,935,155, 1 page.
Chinese Office Action dates Feb. 20, 2019 from Chinese Patent Application No. 2015800125584, 27 pages.
Korean Office Action dated Mar. 13, 2019 from Korean Patent Application No. 10-2014-0106067, 13 pages.
European Office Action dated Mar. 22, 2019 from European Patent Application No. 15735128.9, 96 pages.
Chinese Office Action dated Sep. 6, 2019 from Chinese Patent Application No. 201580012558.4, 34 pages.
Korean Office Action dated Sep. 18, 2019 from Korean Patent Application No. 10-2014-0106067, 7 pages.
Chinese Office Action dated Dec. 30, 2019 from Chinese Patent Application No. 201580012558.4, 7 pages.
International Search Report dated Apr. 10, 2015 in corresponding International Application No. PCT/KR2015/000156.
Written Opinion dated Apr. 10, 2015 in corresponding International Application No. PCT/KR2015/000156.
Korean Office Action dated Mar. 12, 2020 from Korean Patent Application No. 10-2014-0106067, 9 pages.
Korean Office Action dated Apr. 22, 2020 from Korean Application No. 10-2014-0106067, 7 pages.

* cited by examiner

[Fig. 1]
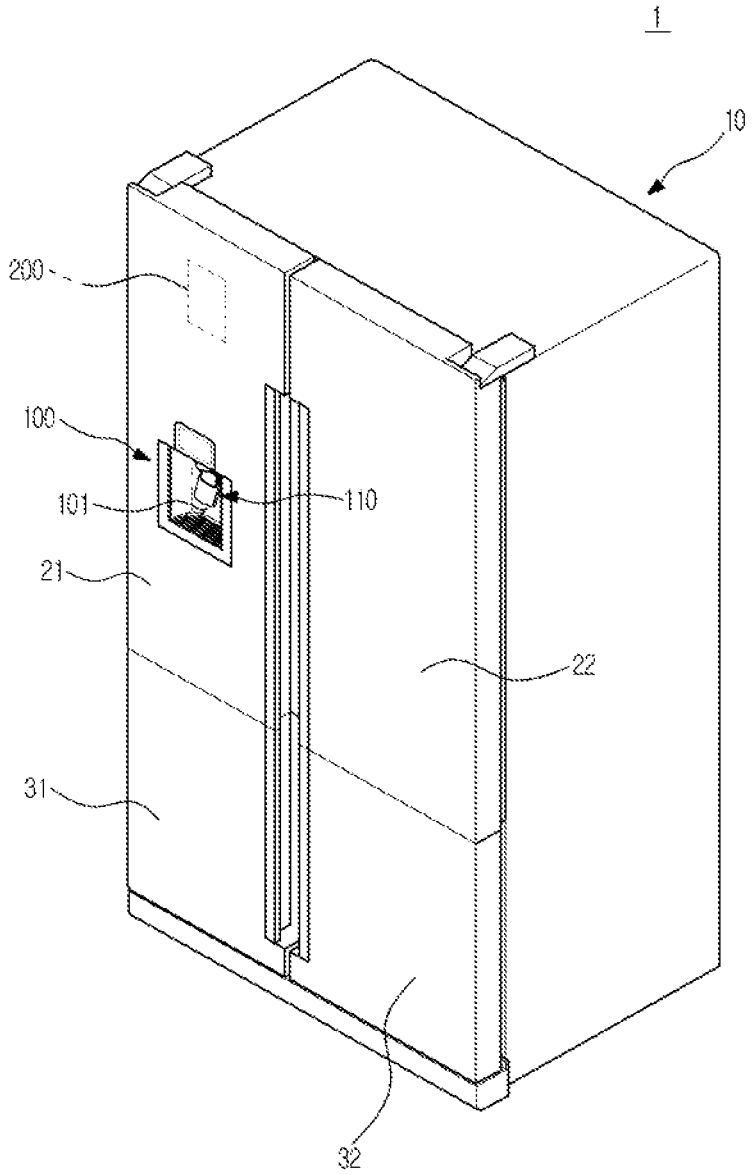

[Fig. 2]
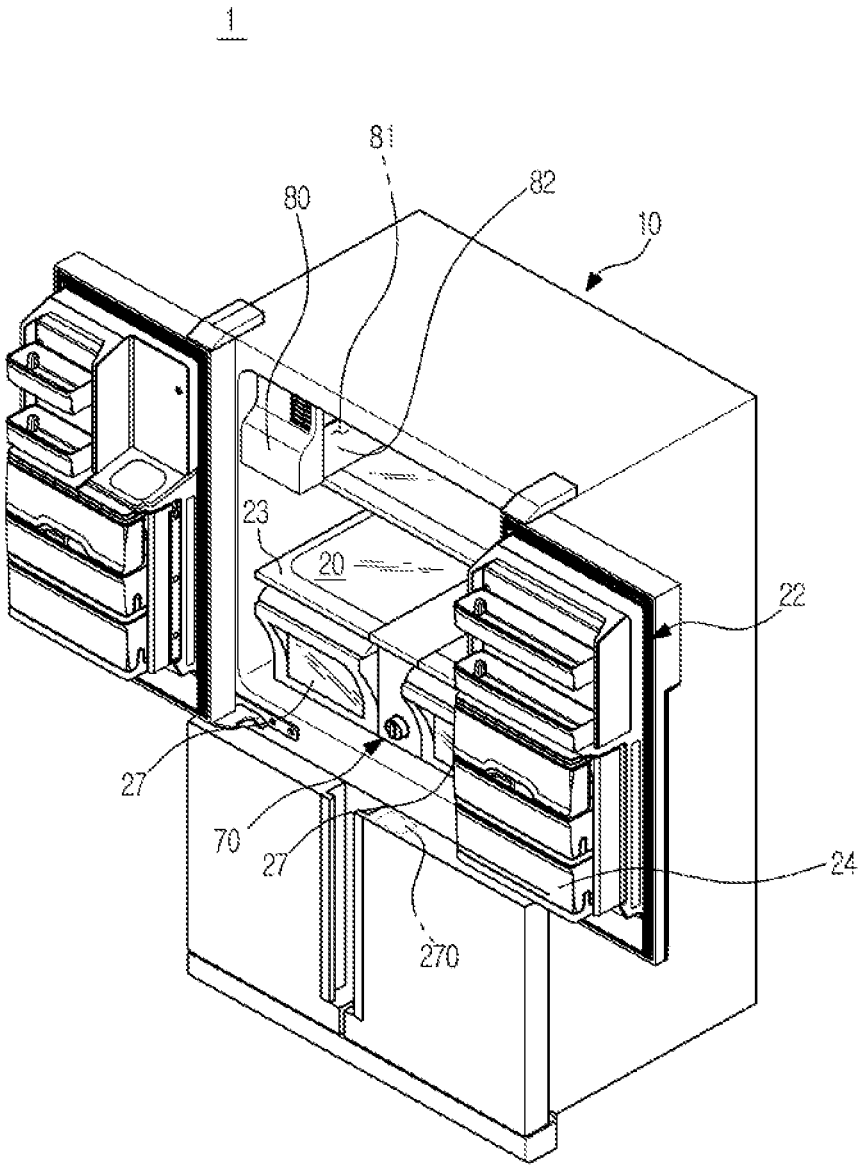

[Fig. 3]
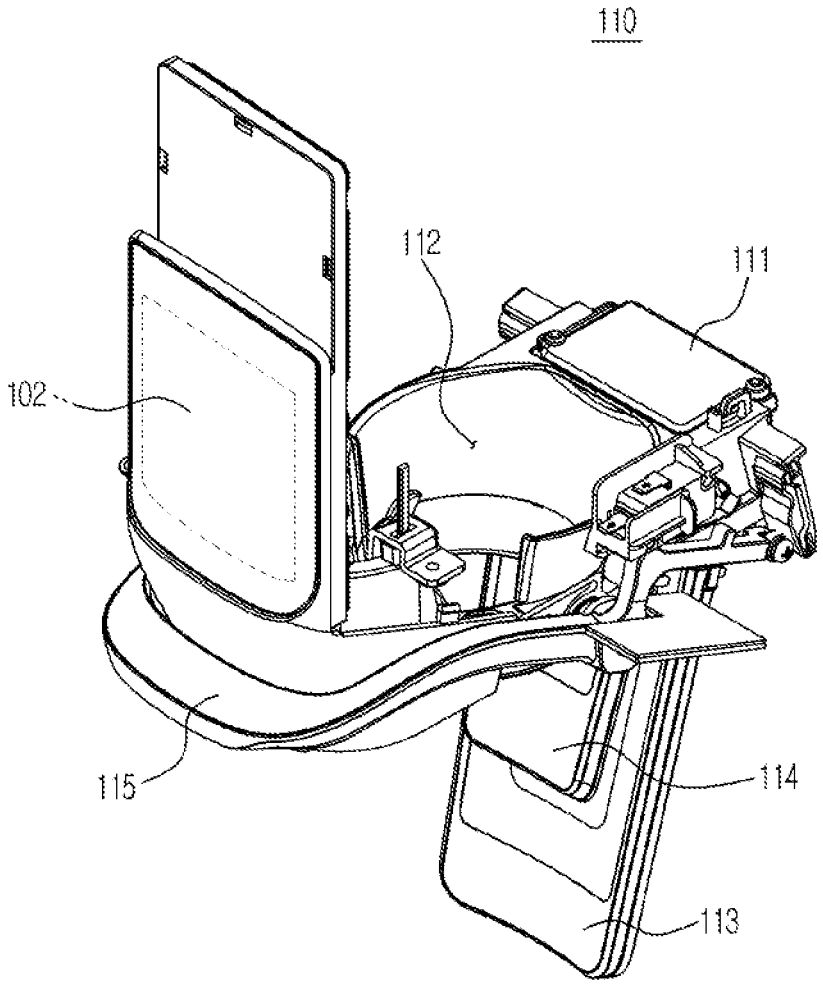

[Fig. 4]
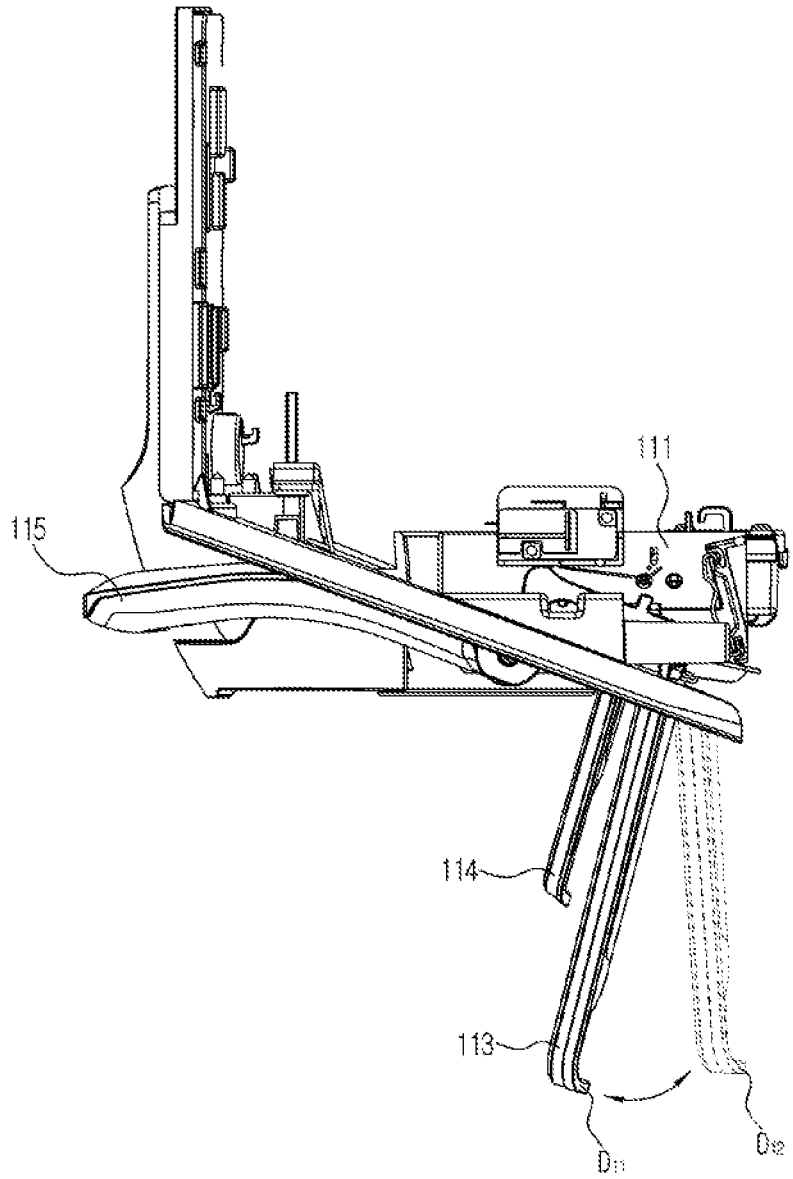

[Fig. 5]
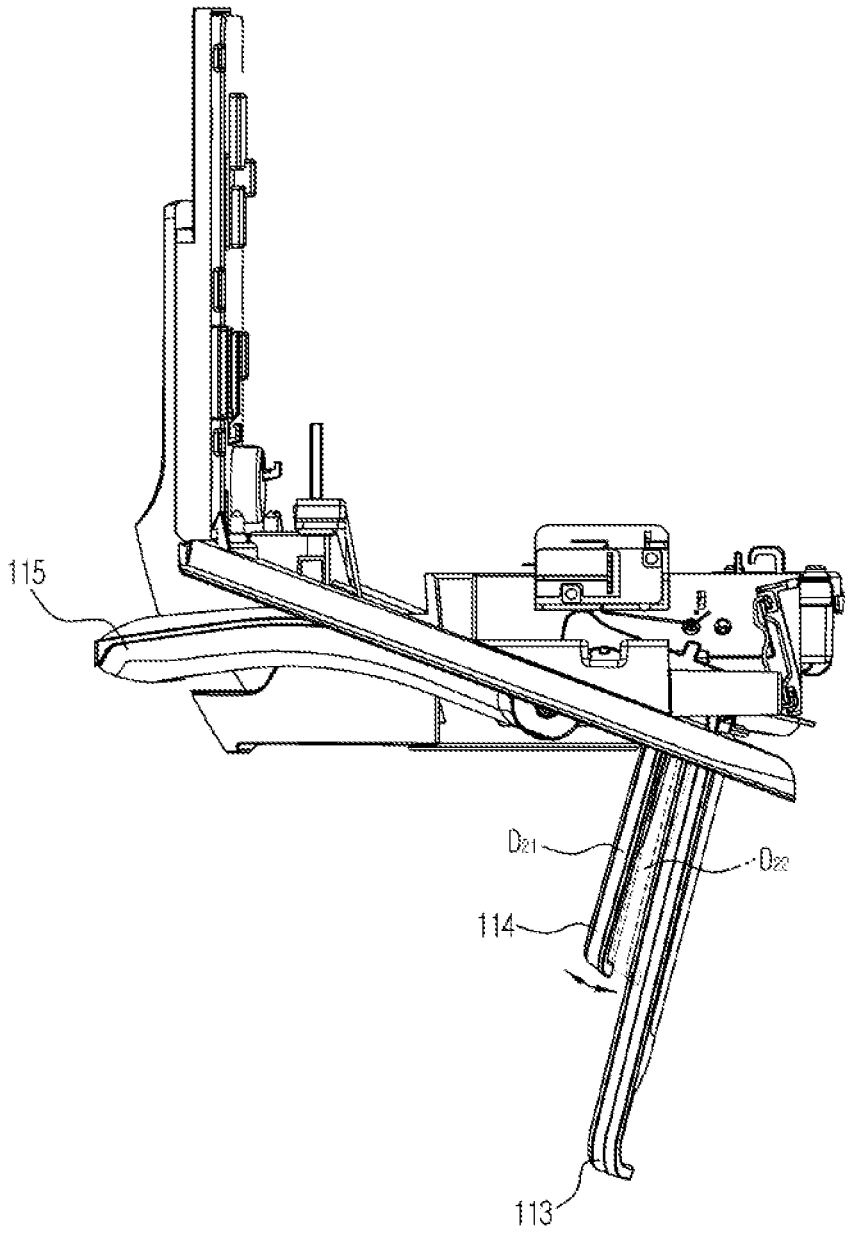

[Fig. 6]
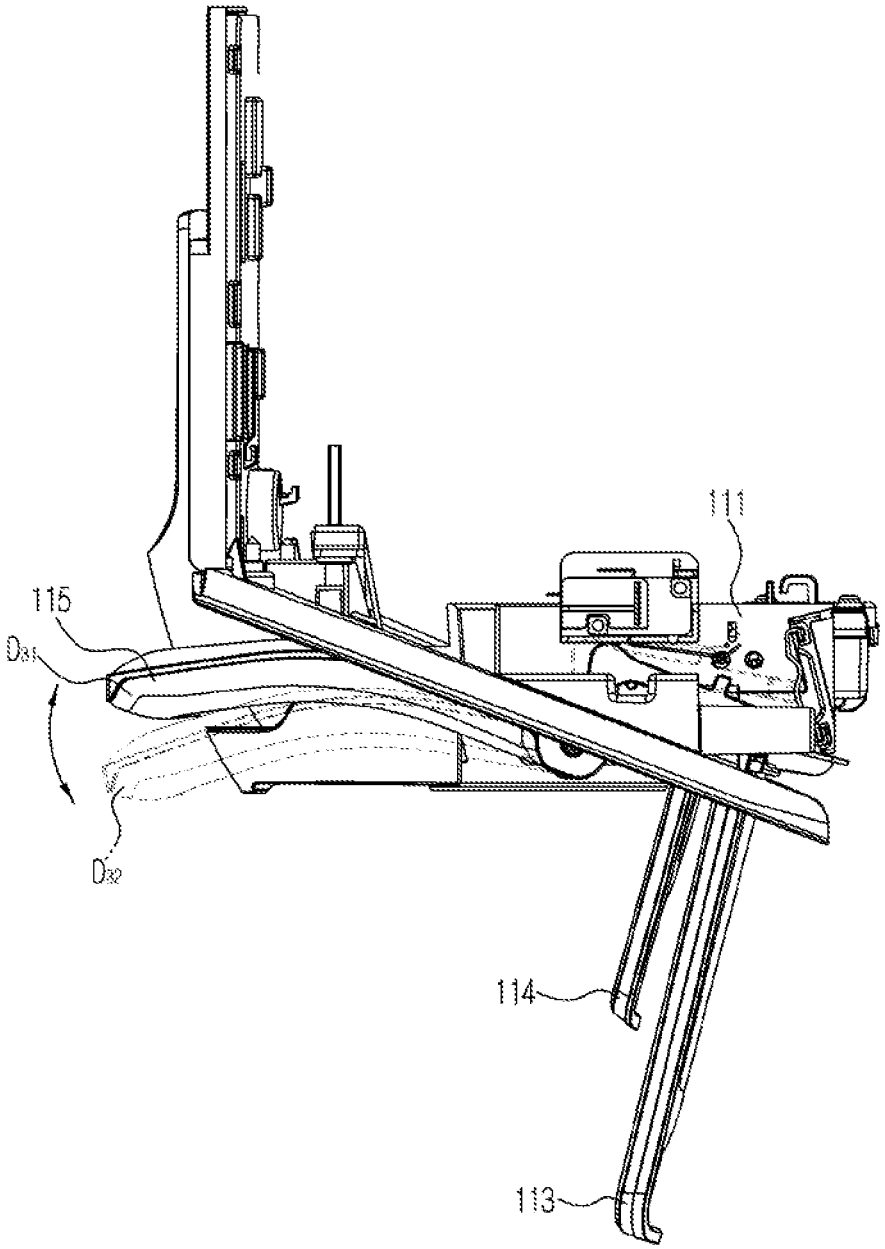

[Fig. 7]
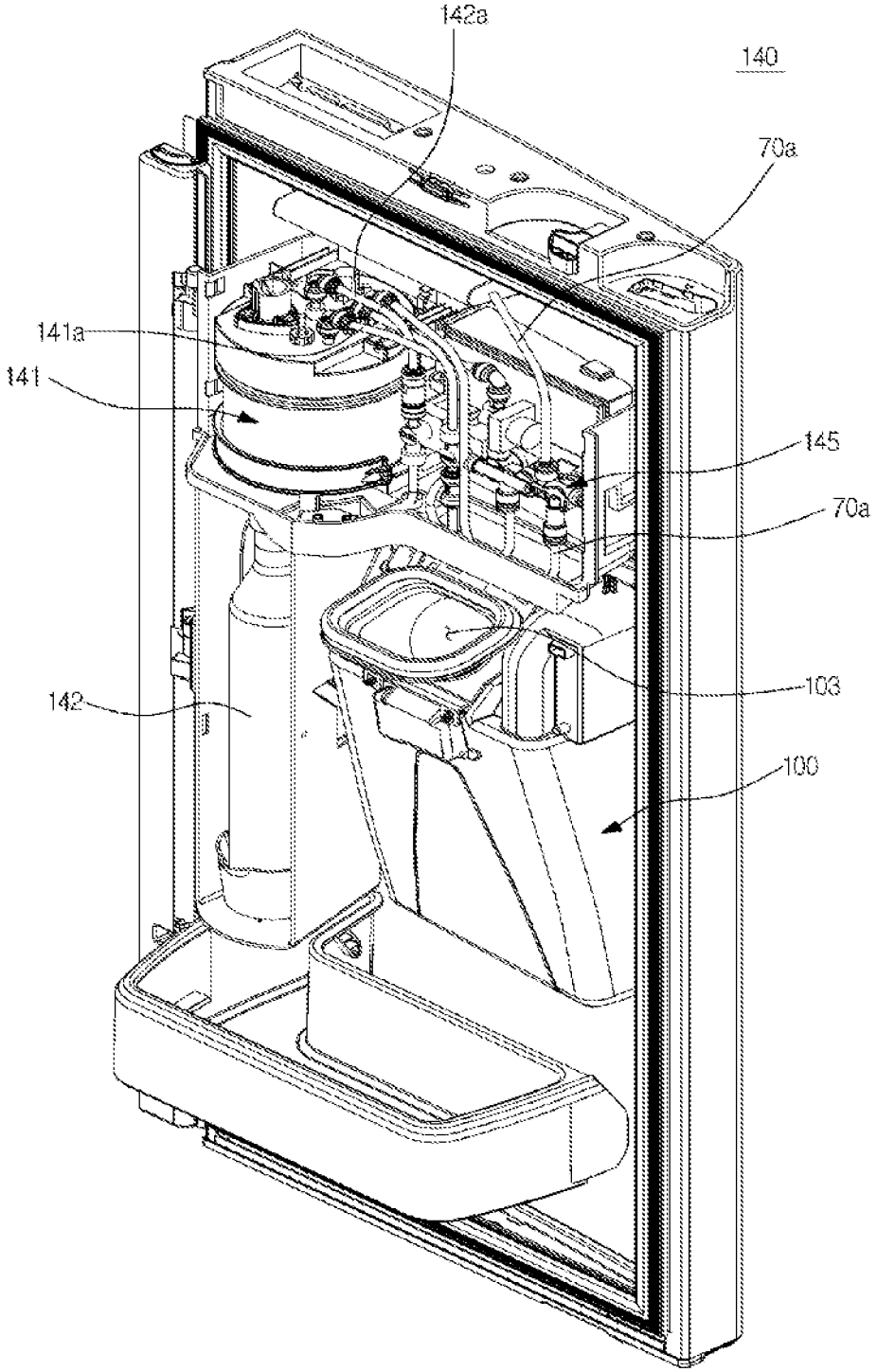

[Fig. 8]
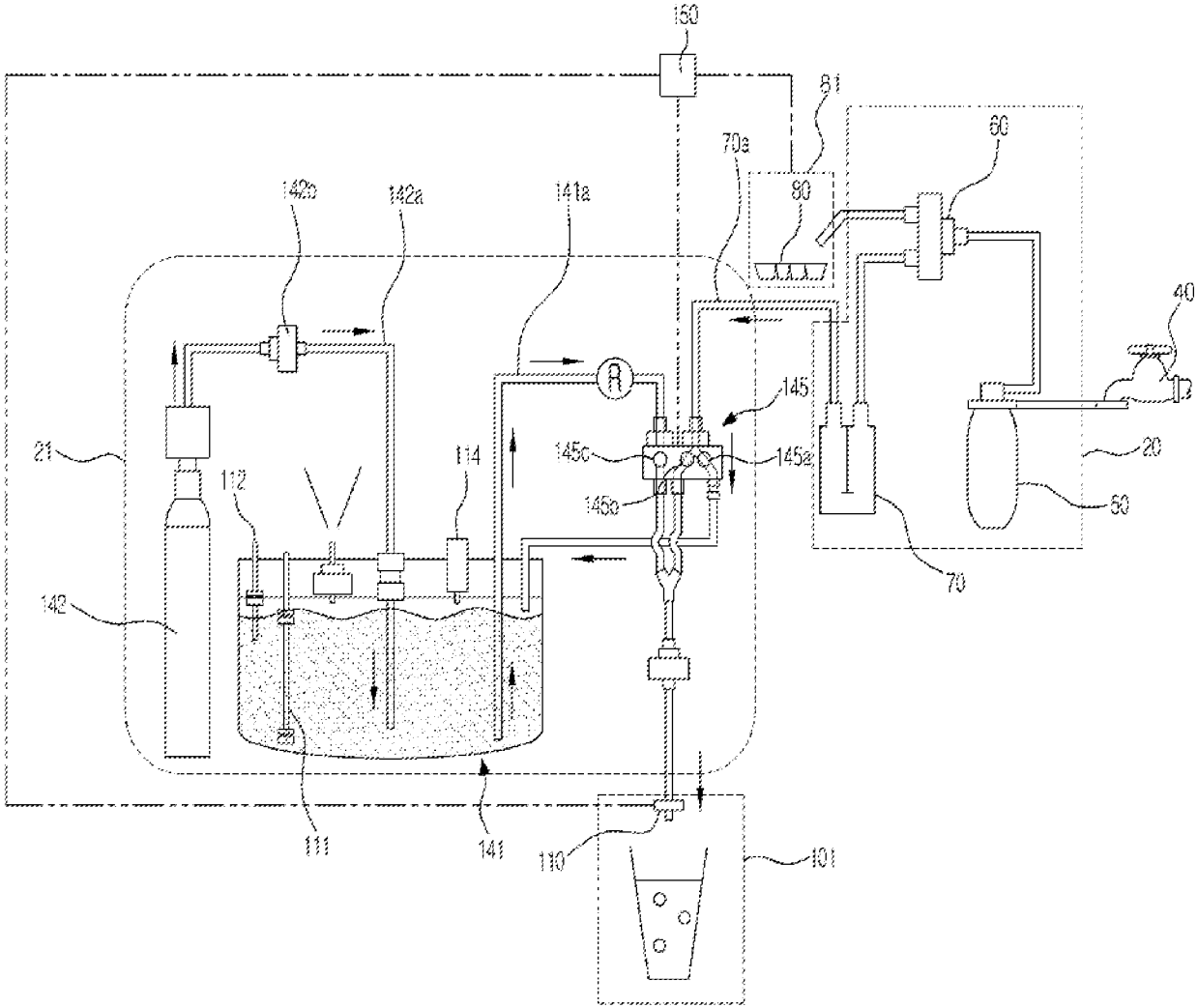

[Fig. 9]
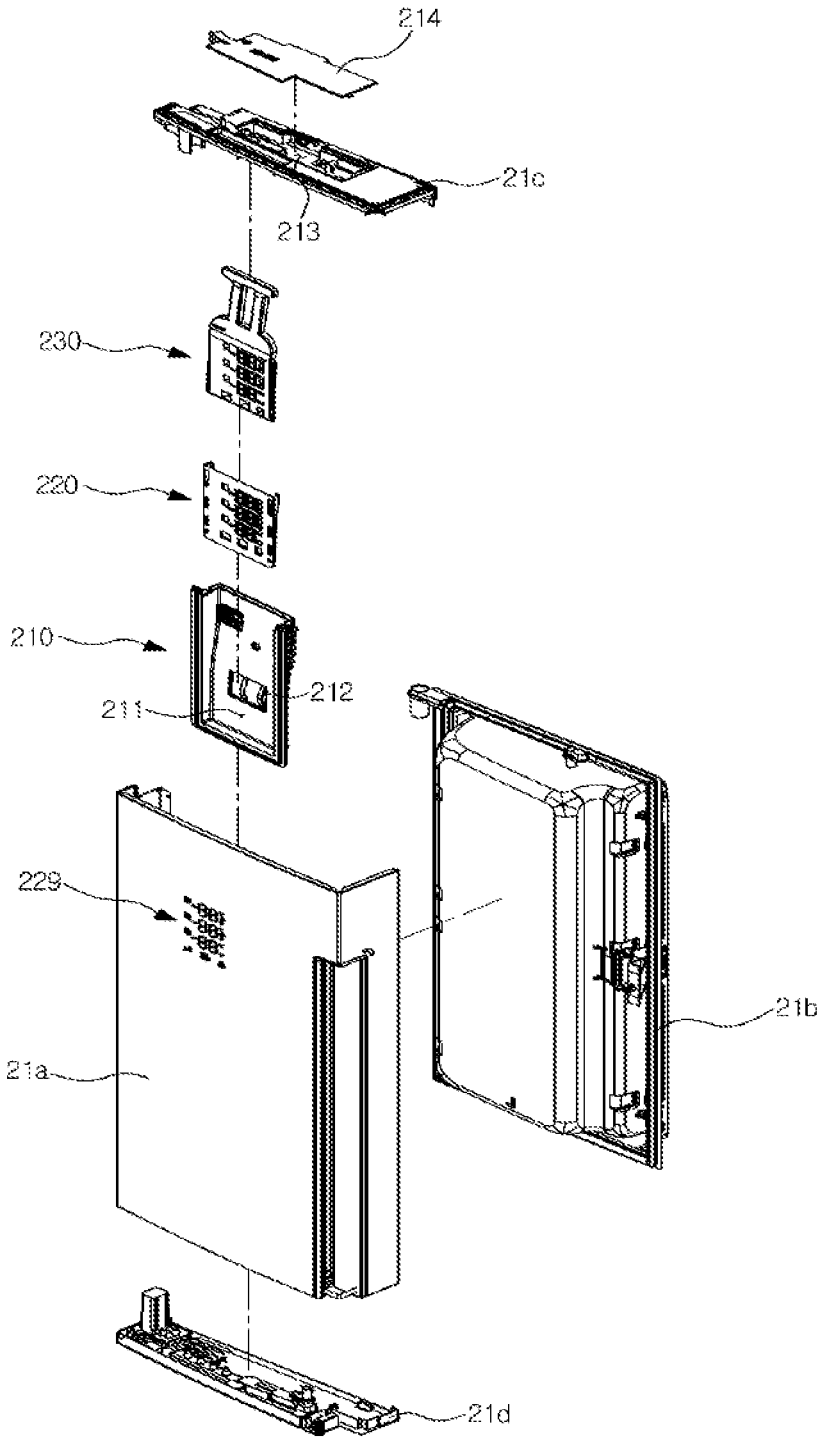

[Fig. 10]
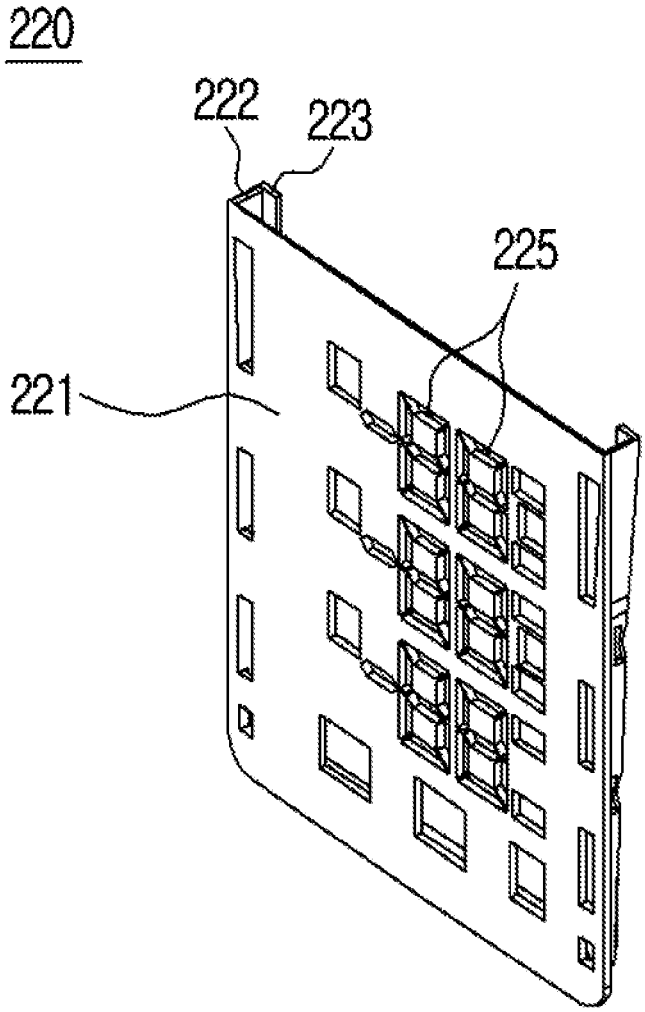

[Fig. 11]
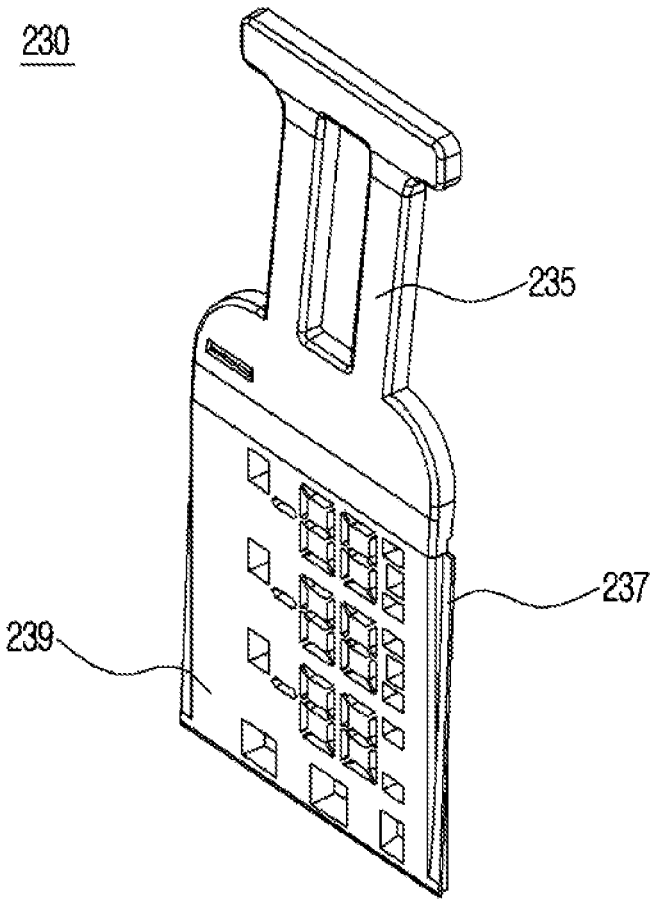

[Fig. 12]
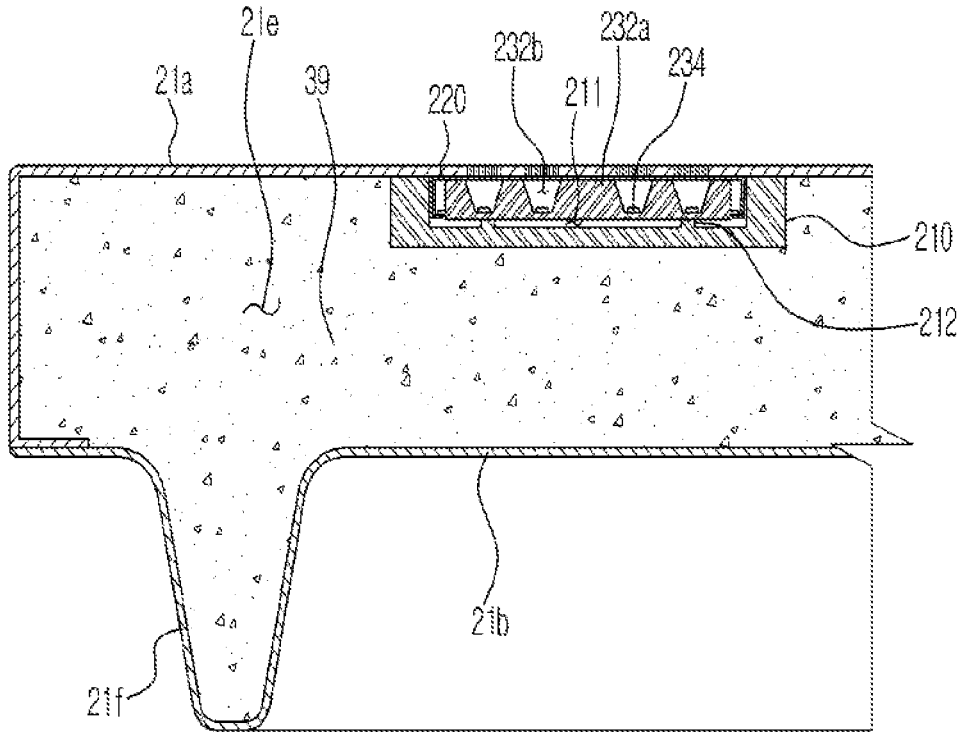

[Fig. 13]
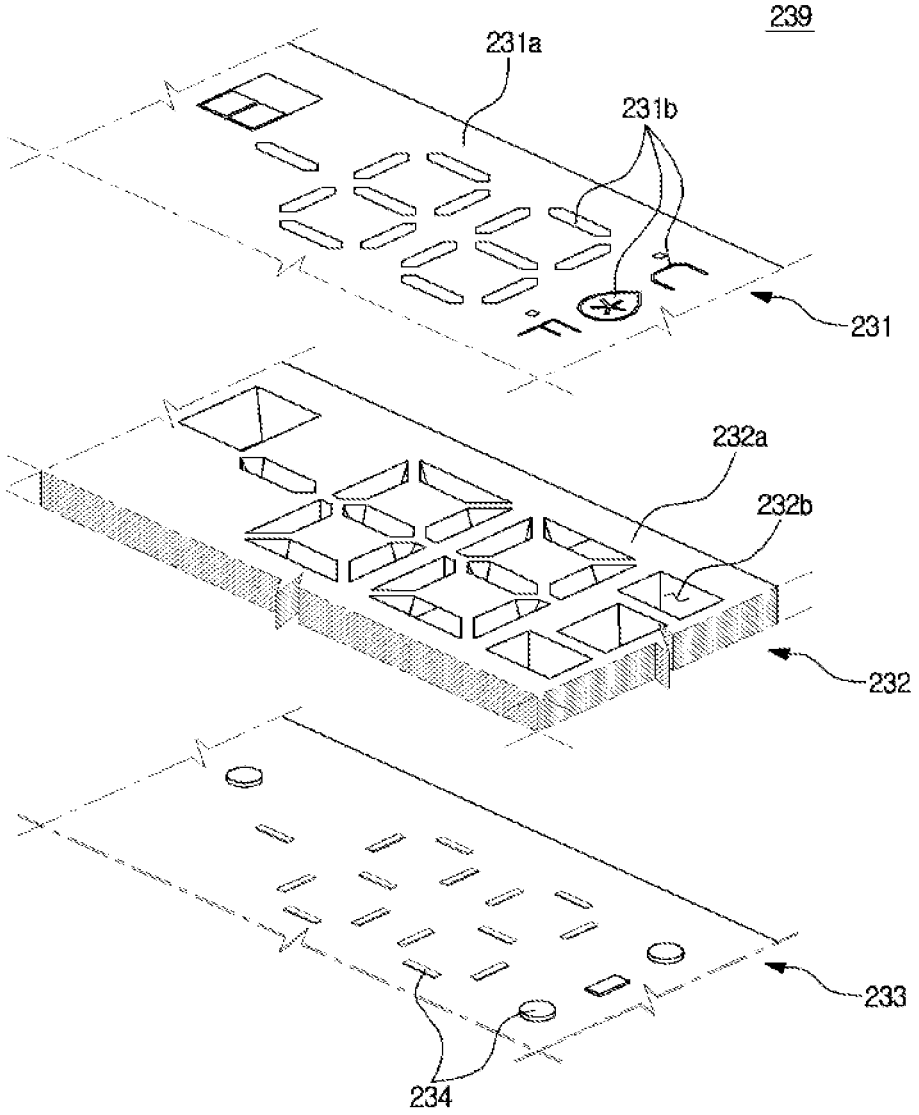

[Fig. 14]
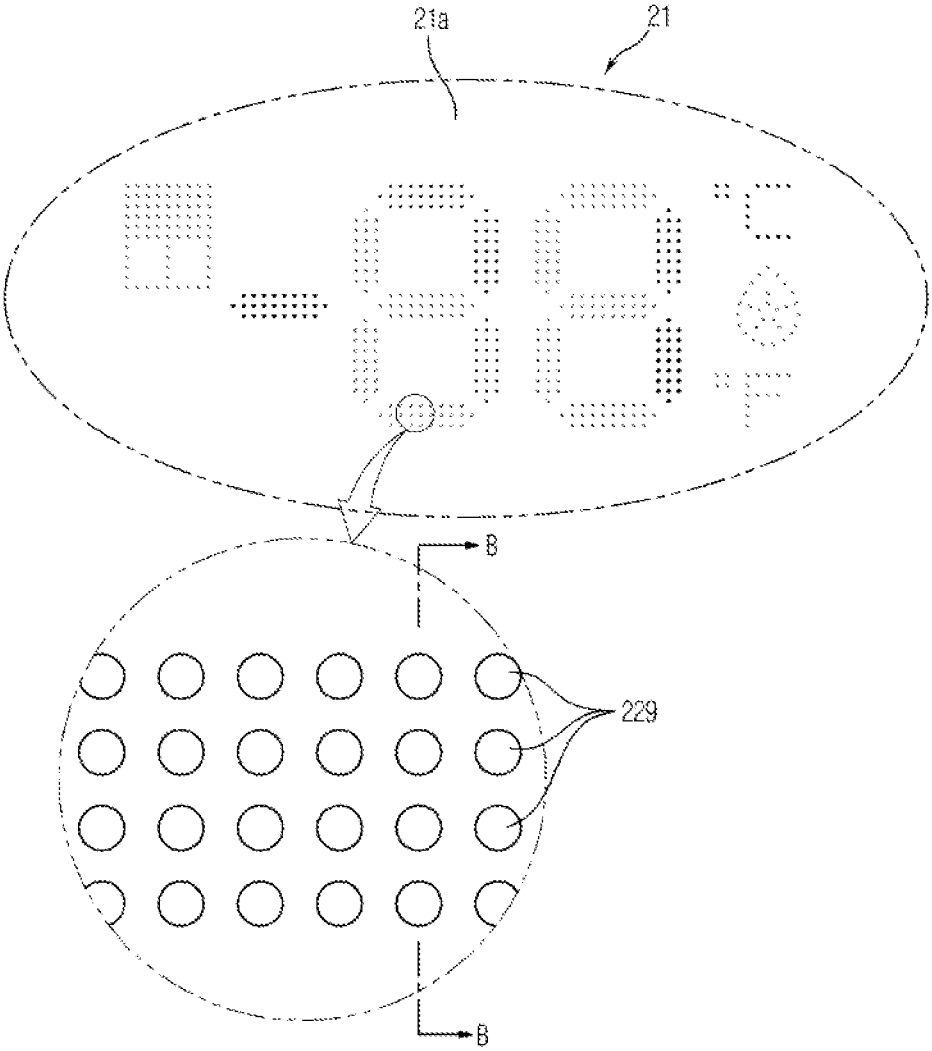

[Fig. 15]
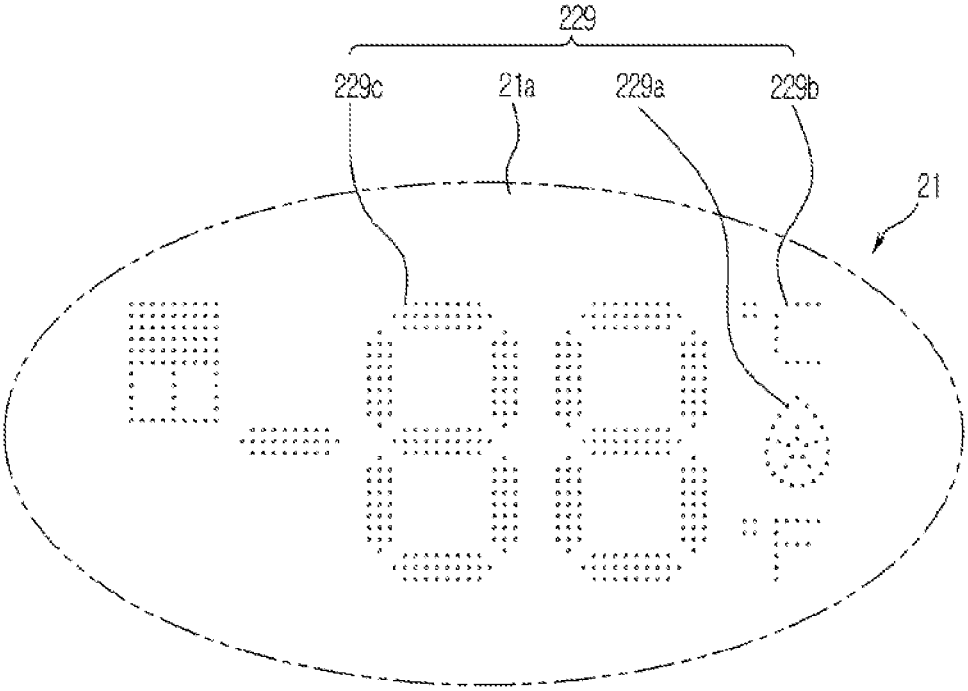
[Fig. 16]
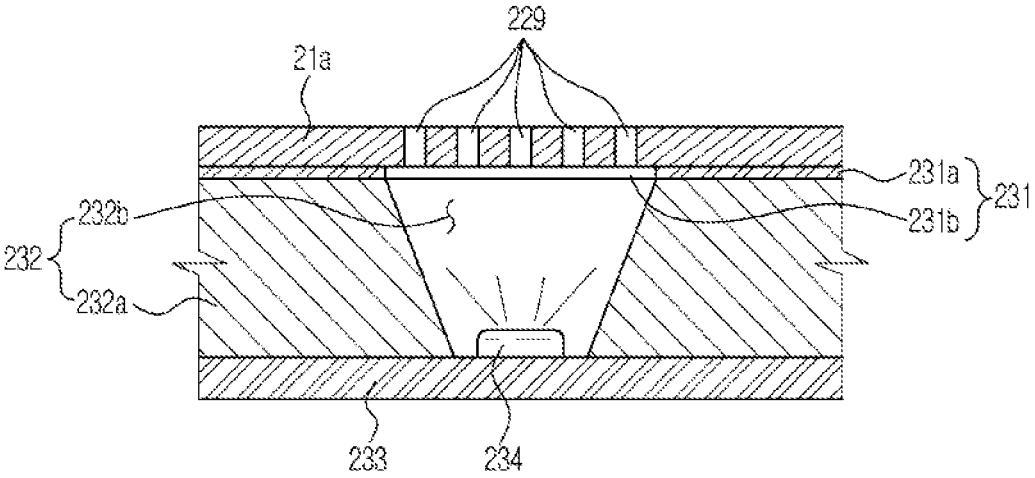

[Fig. 17]
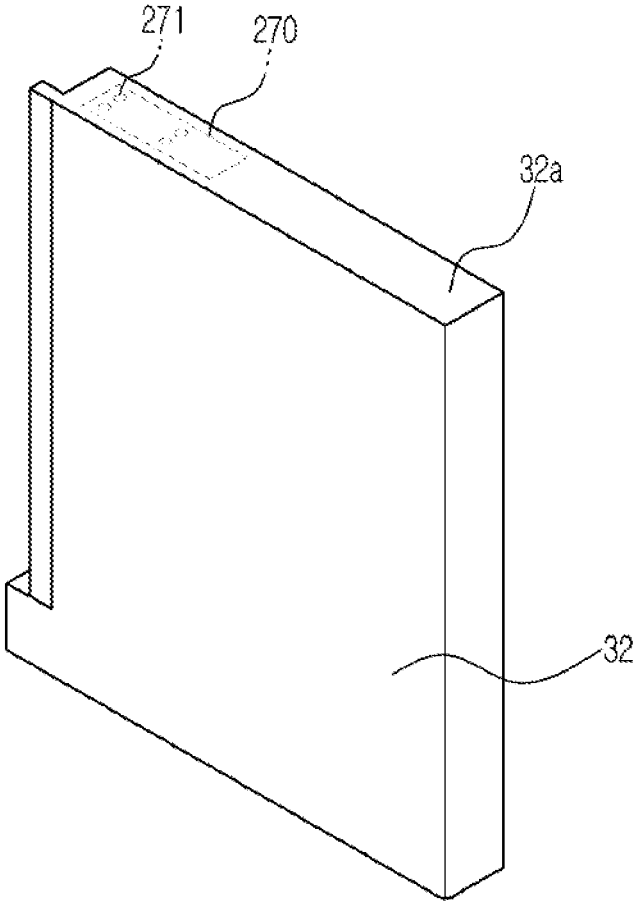

[Fig. 18]
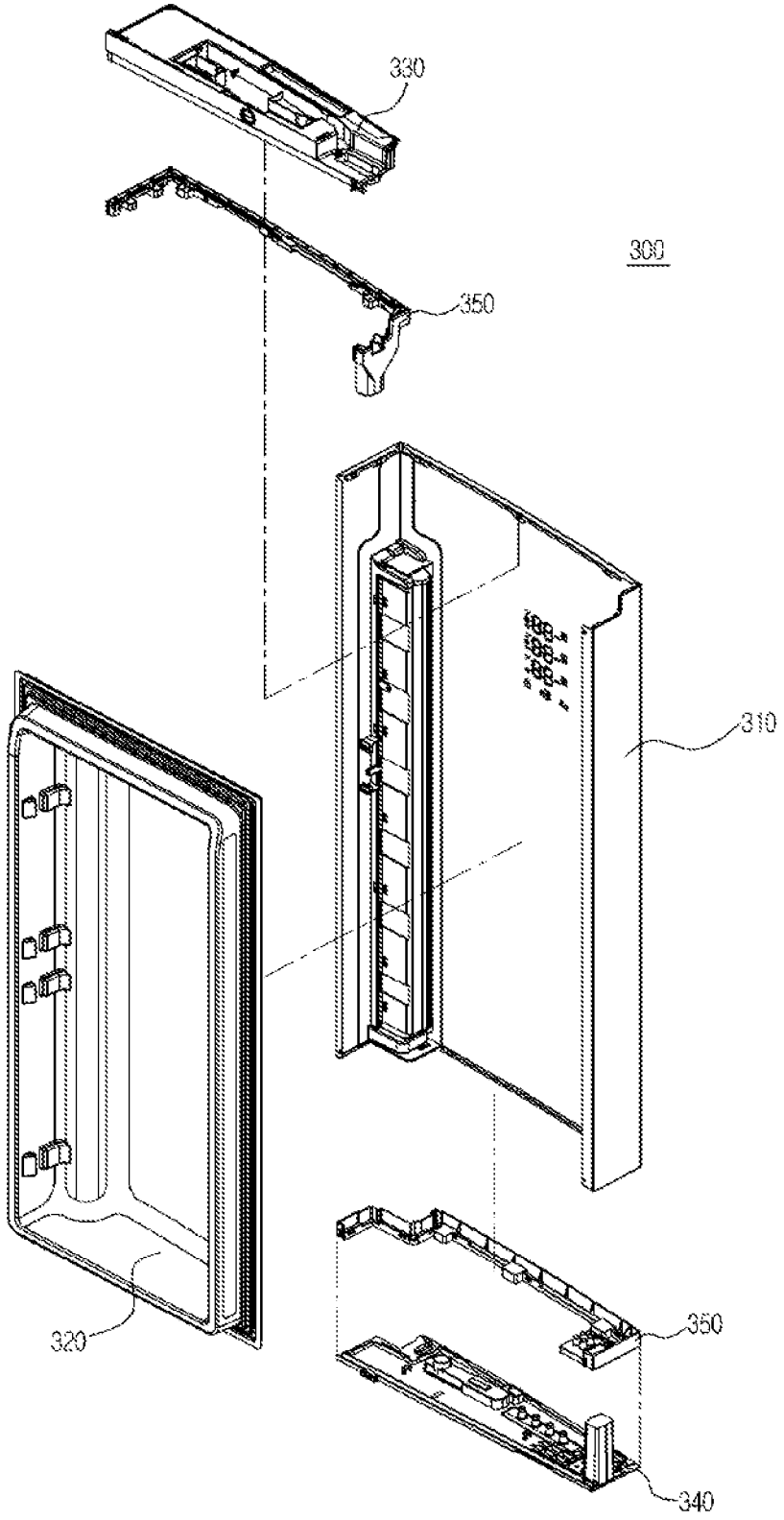

[Fig. 19]
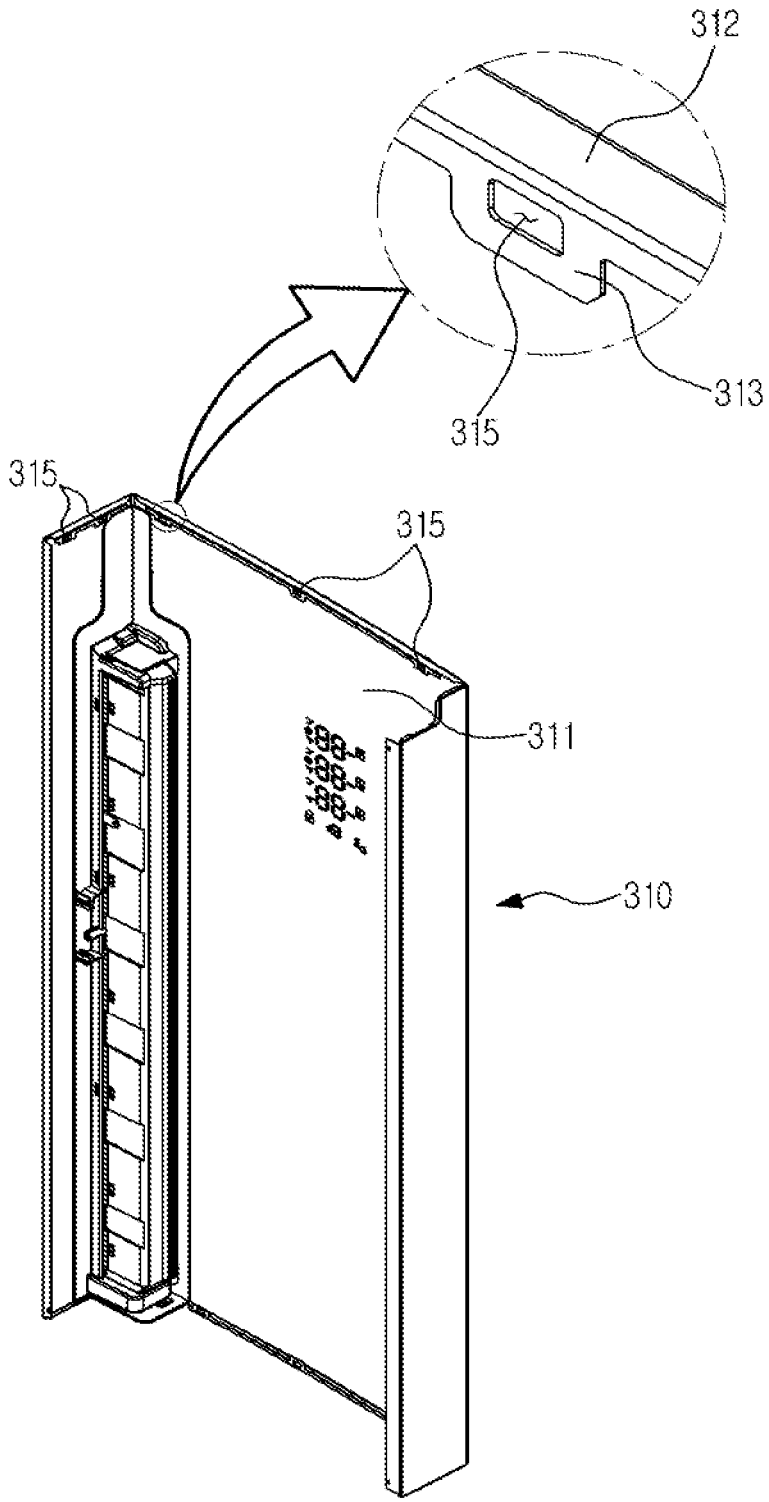

[Fig. 20]
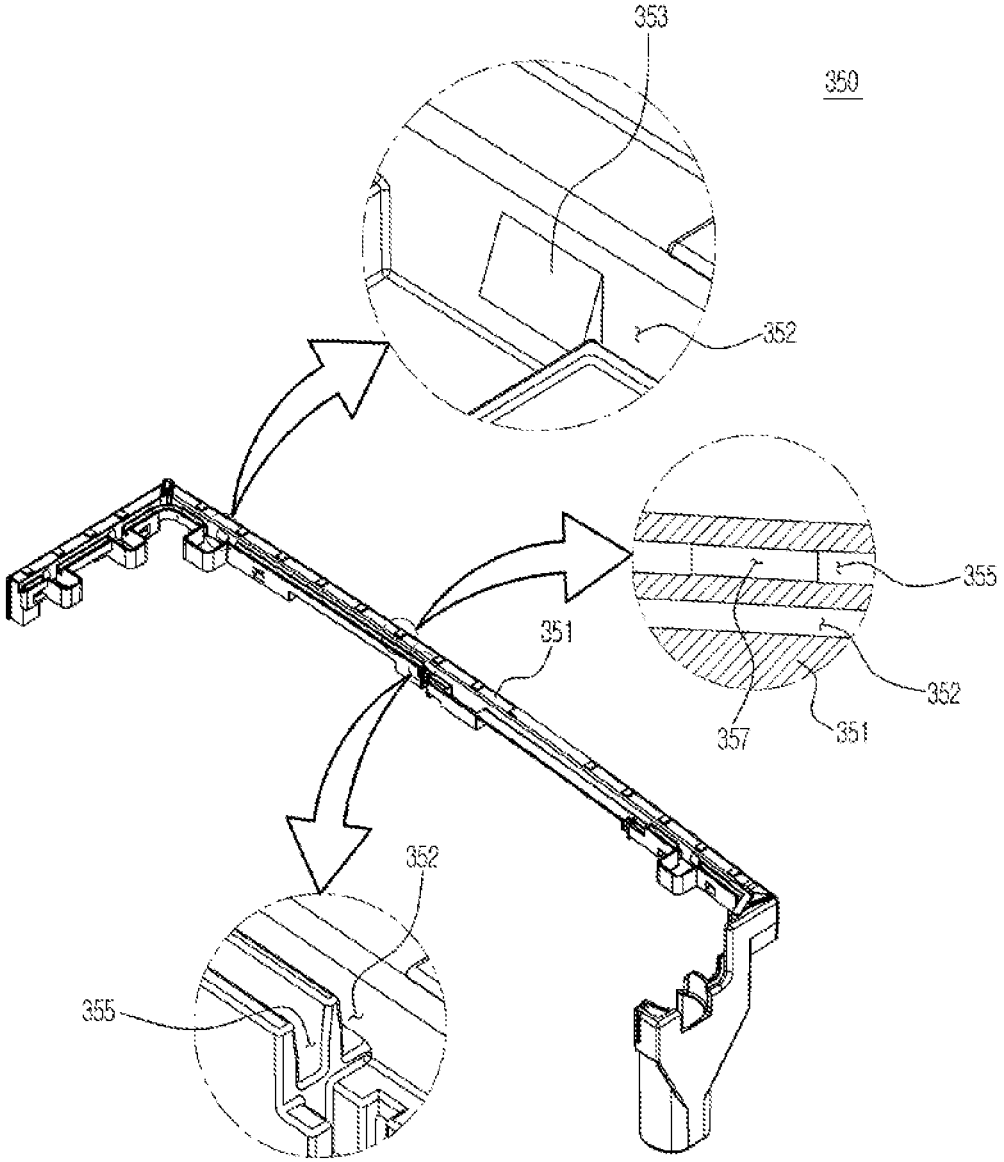

[Fig. 21]
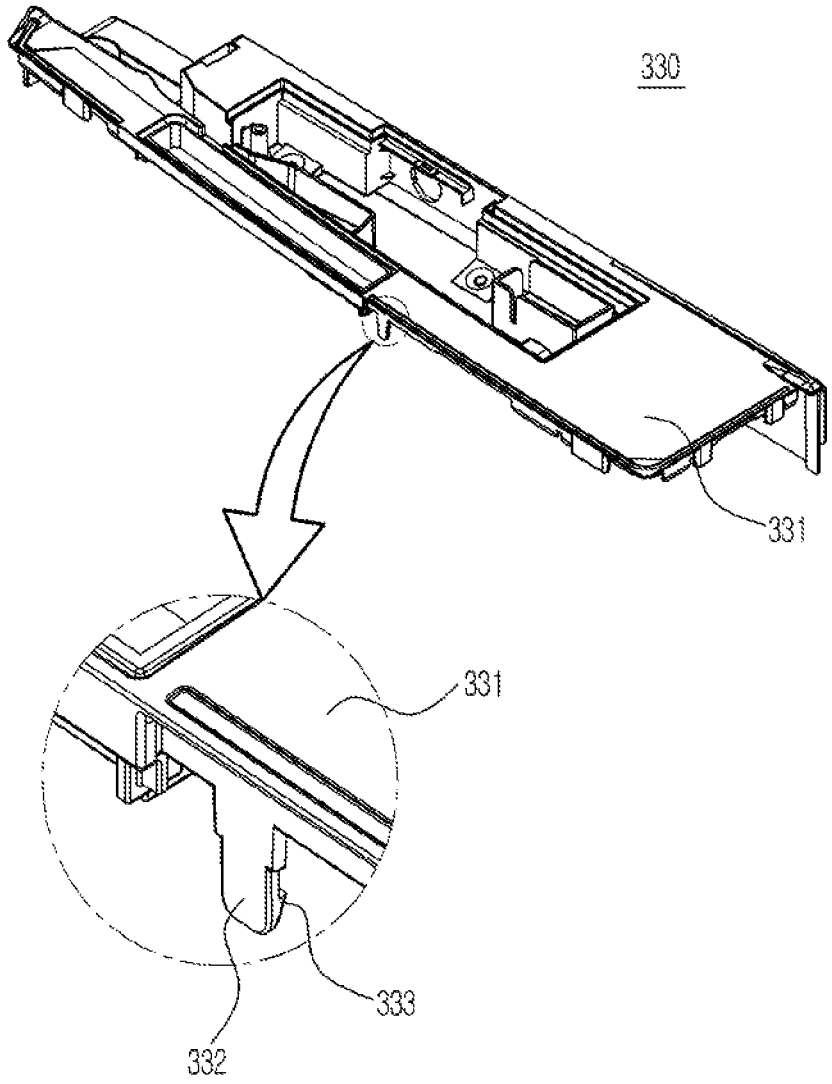

[Fig. 22]
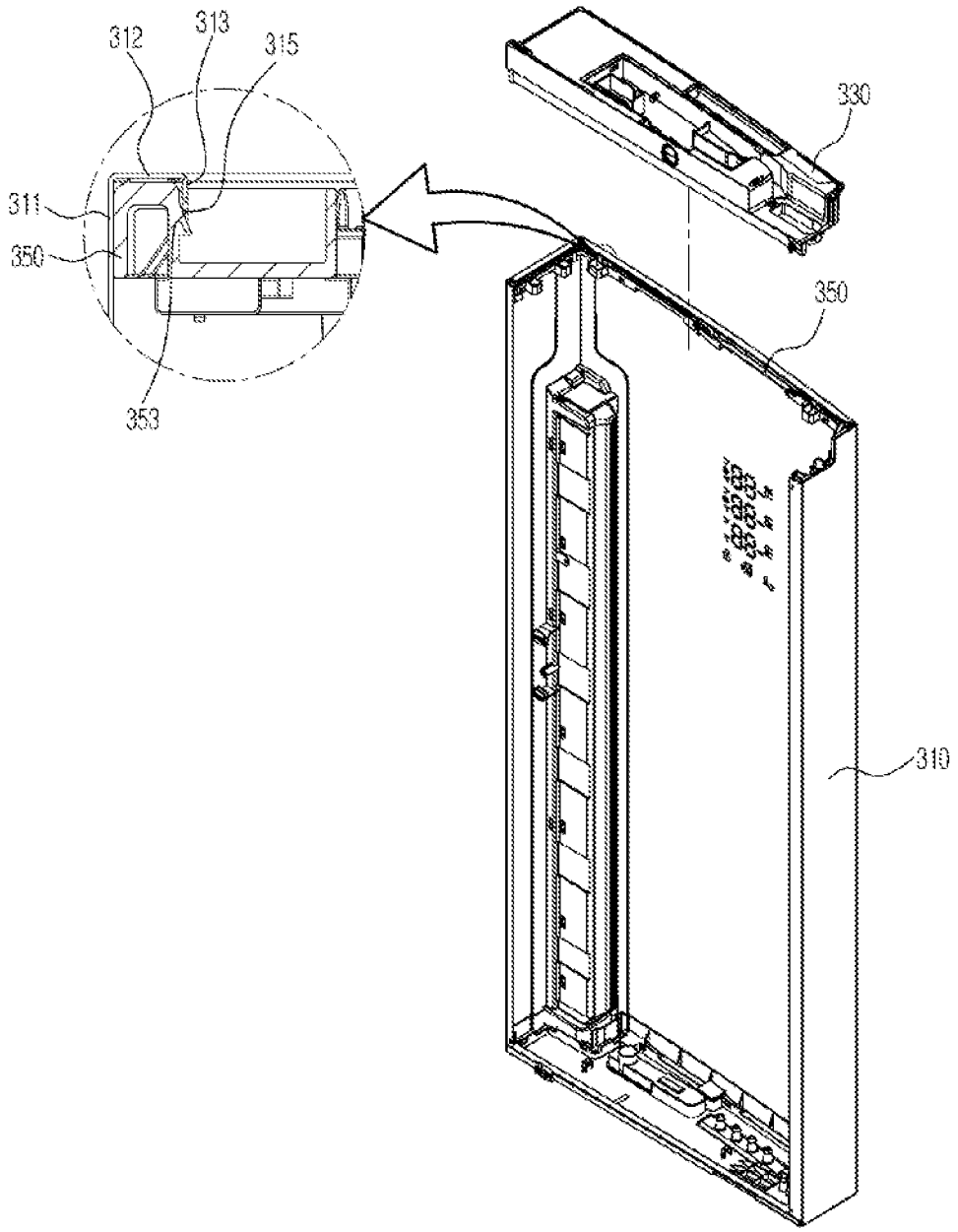

[Fig. 23]
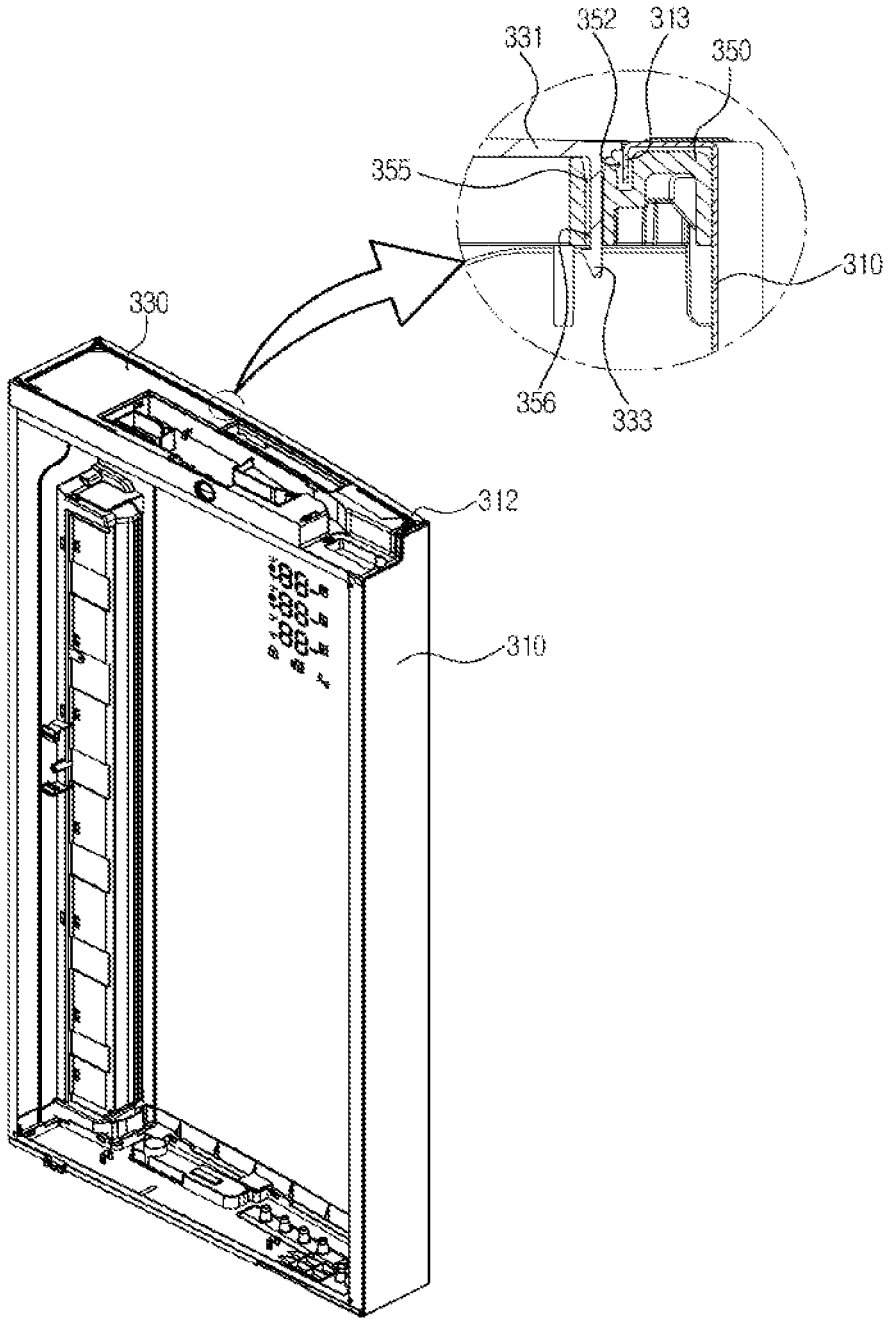

[Fig. 24]
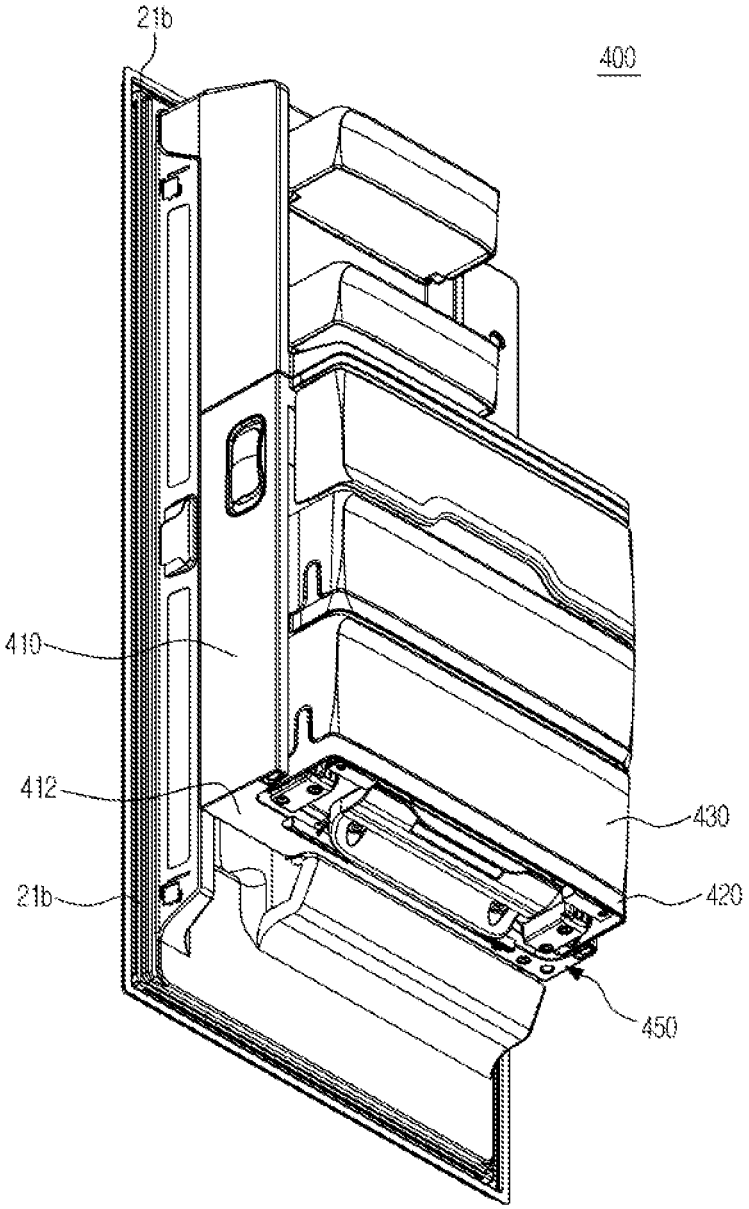

[Fig. 25]
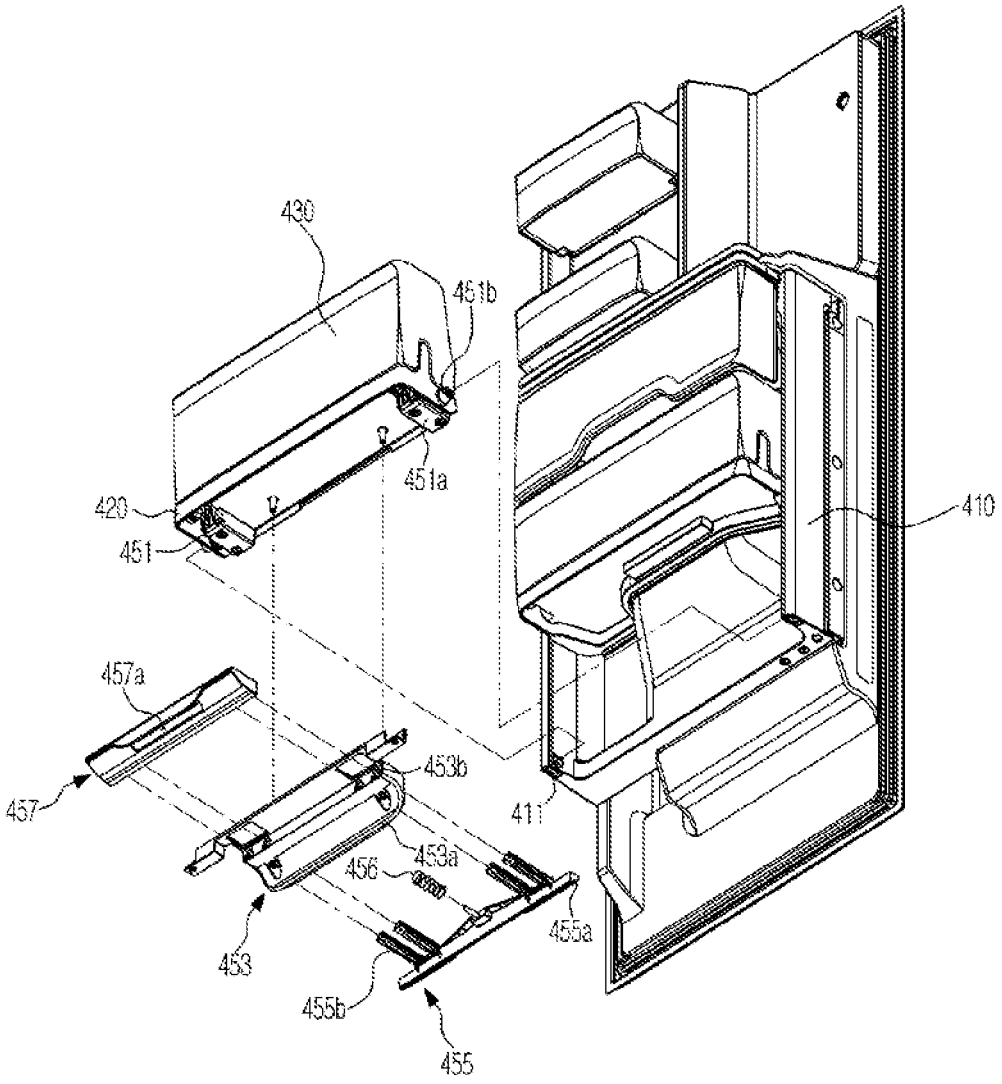

[Fig. 26]
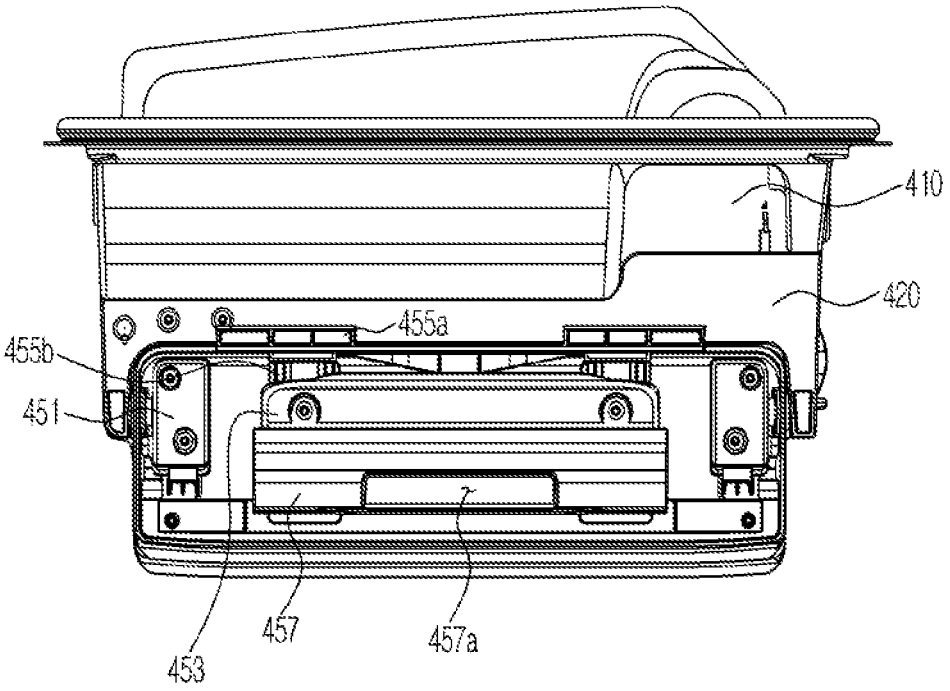

[Fig. 27]
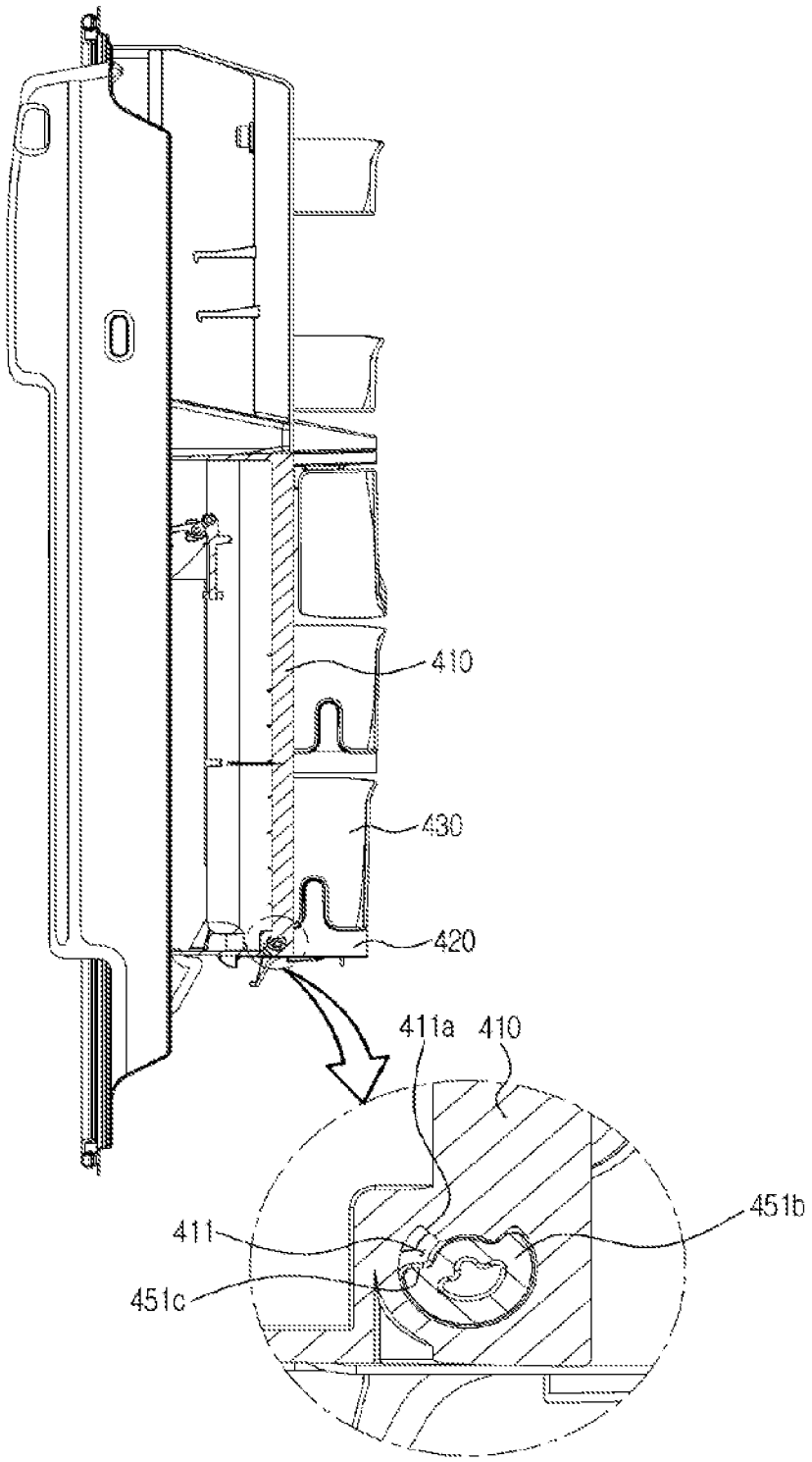

[Fig. 28]
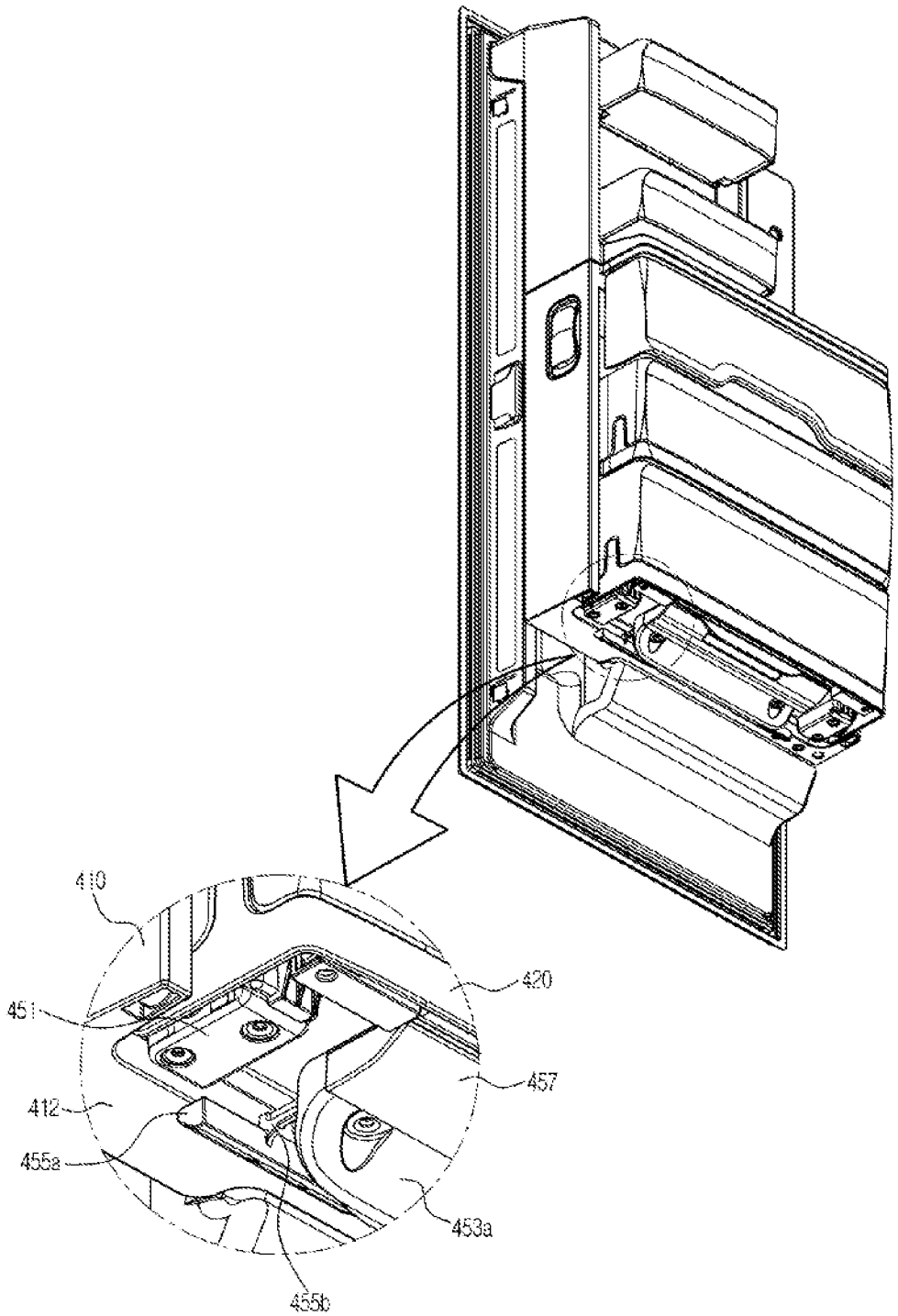

[Fig. 29]
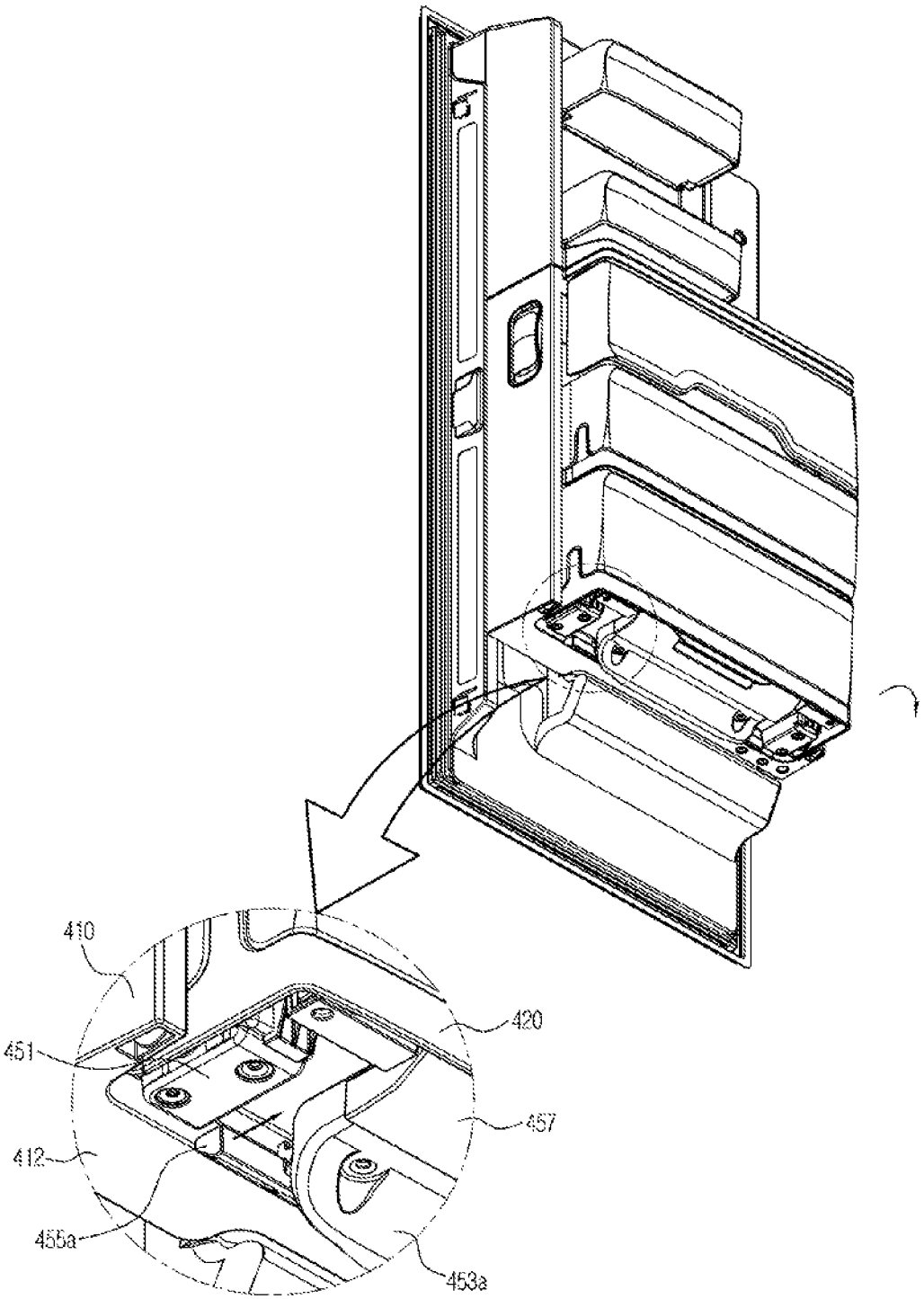

[Fig. 30]
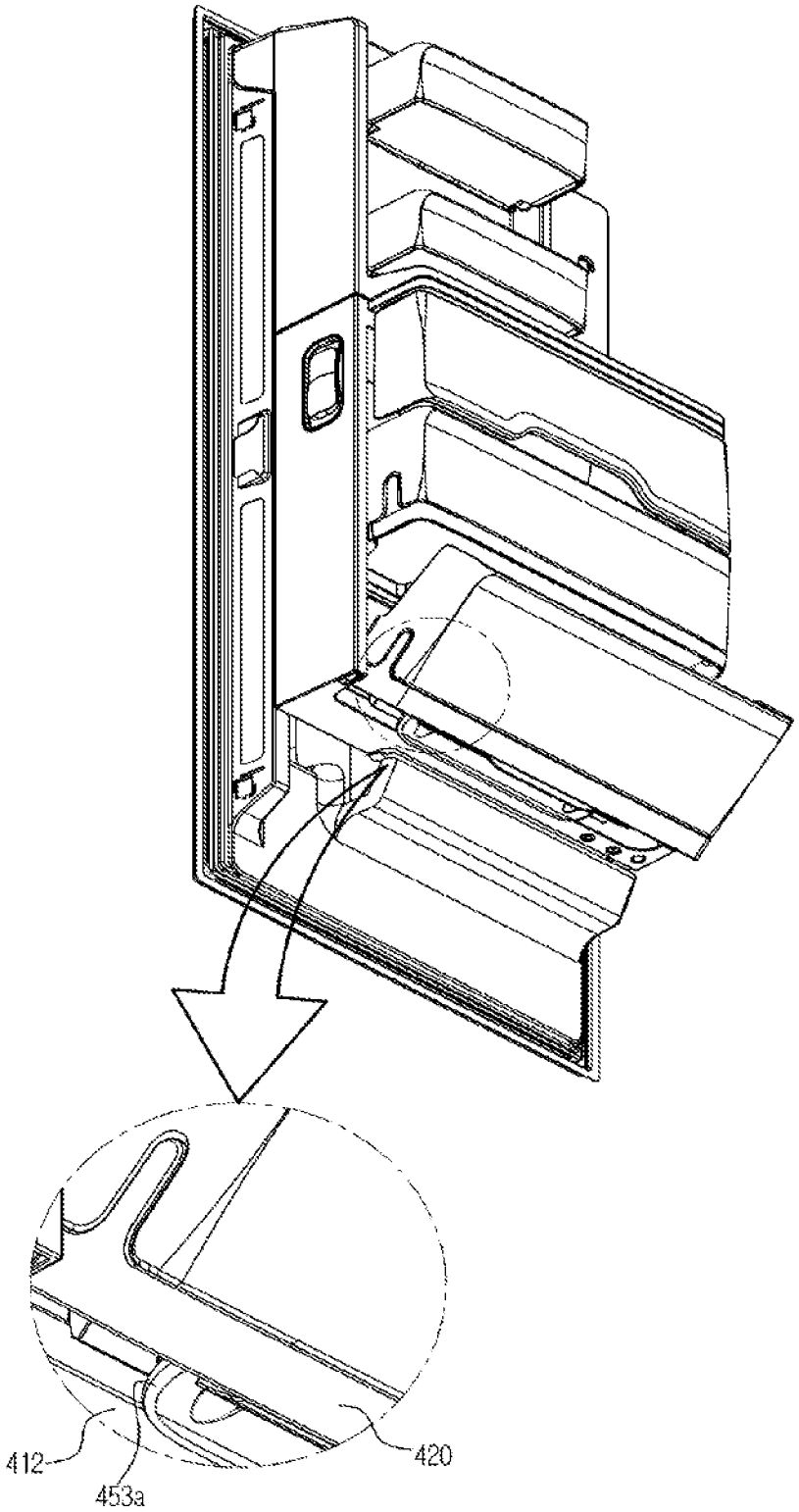

[Fig. 31]
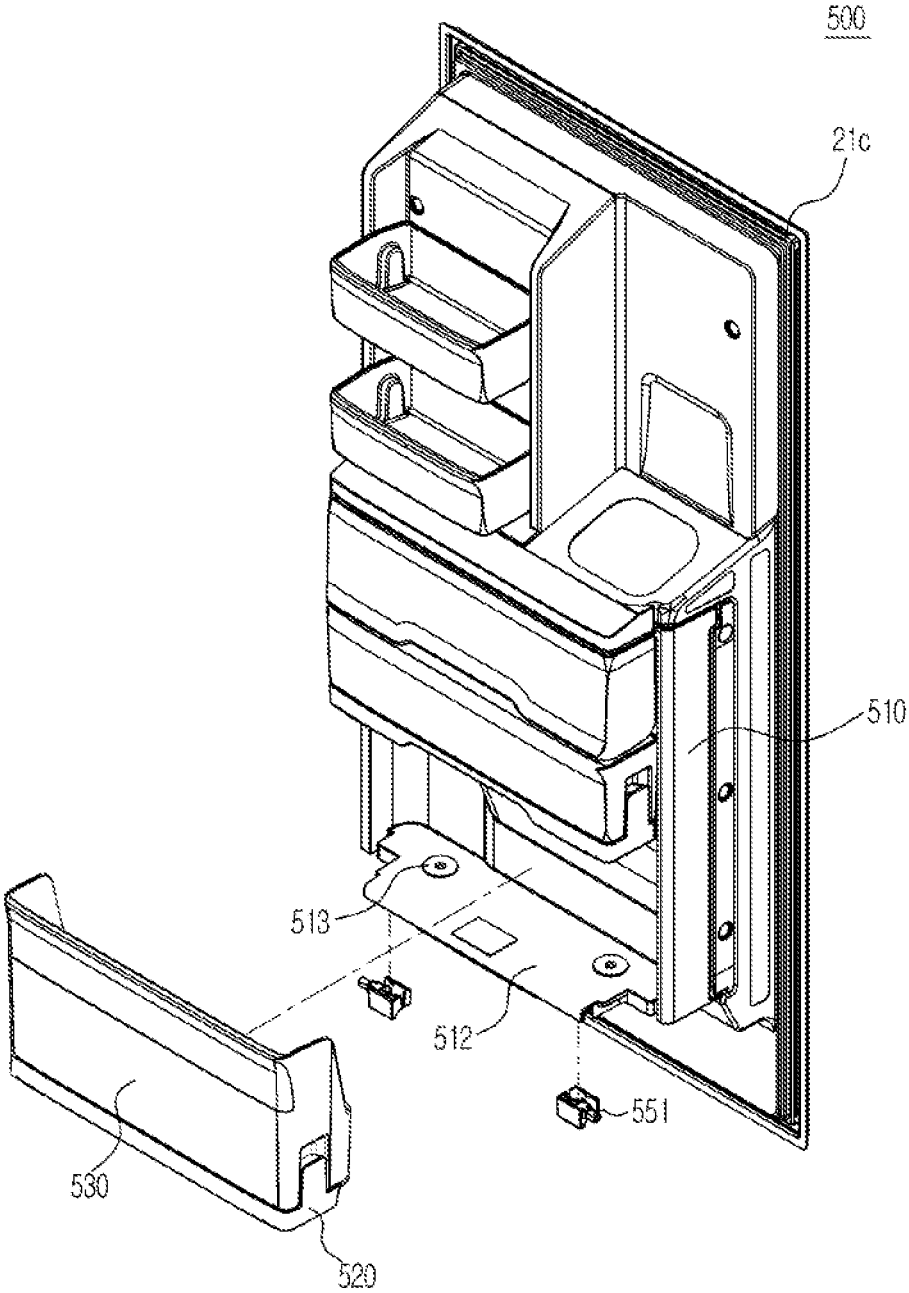

[Fig. 32]
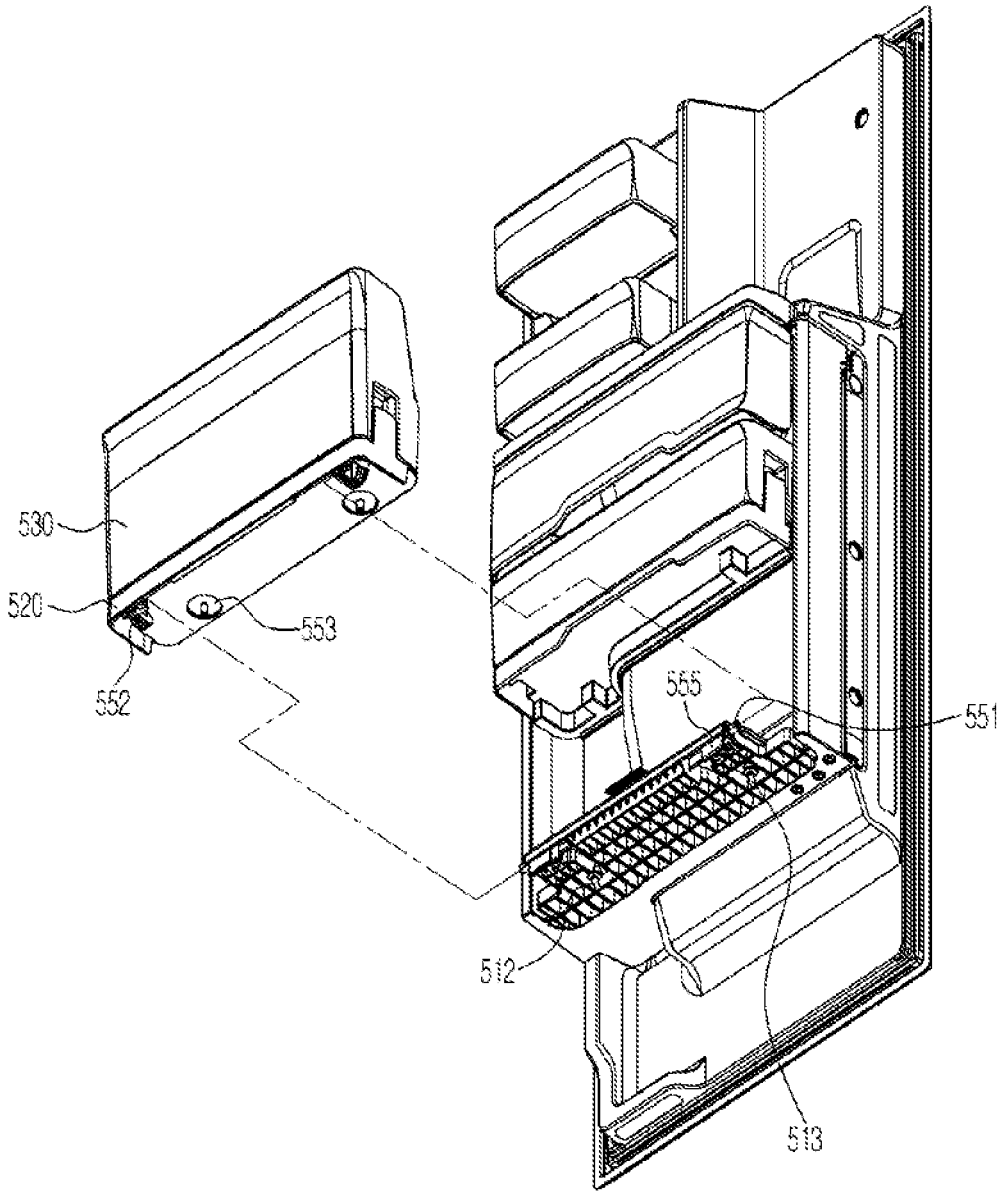

[Fig. 33]
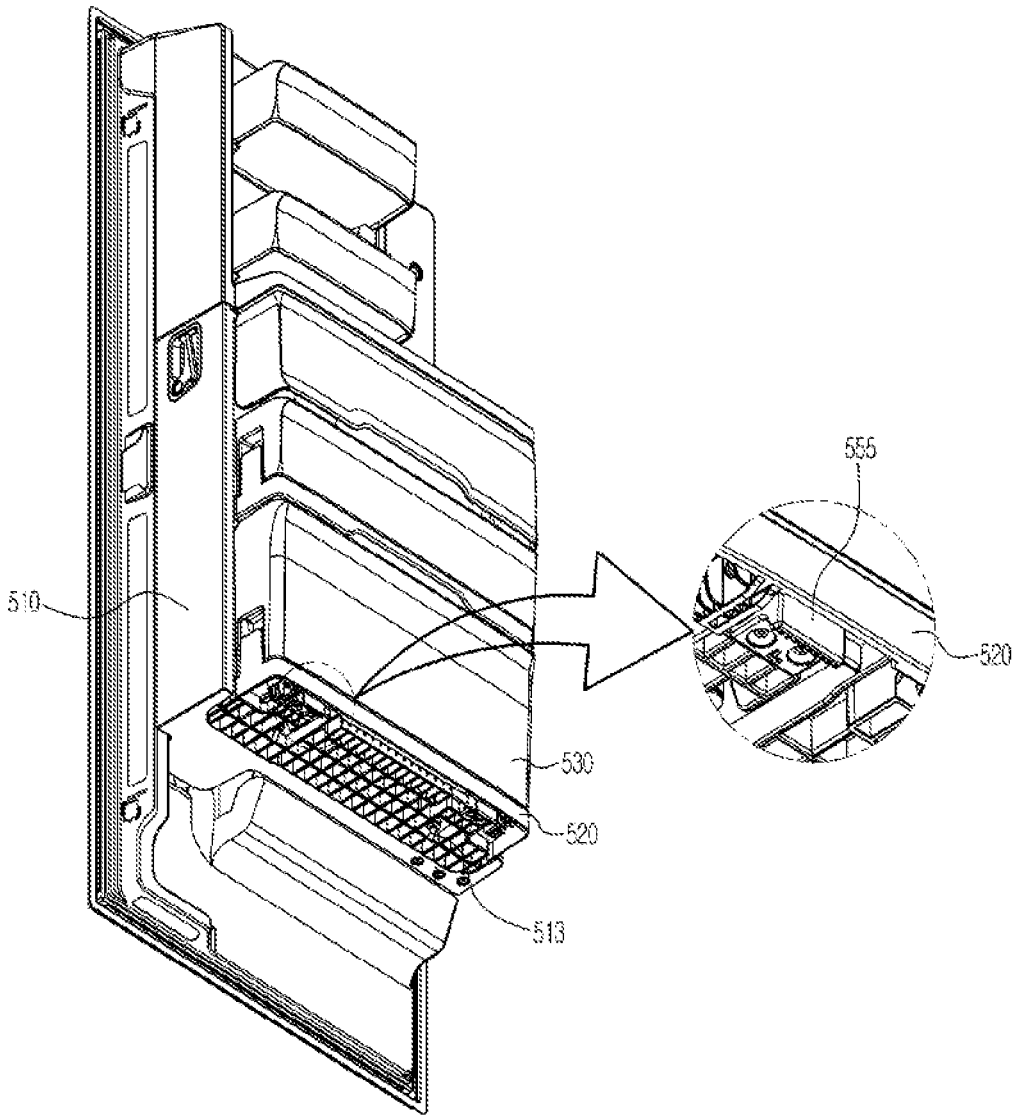

[Fig. 34]
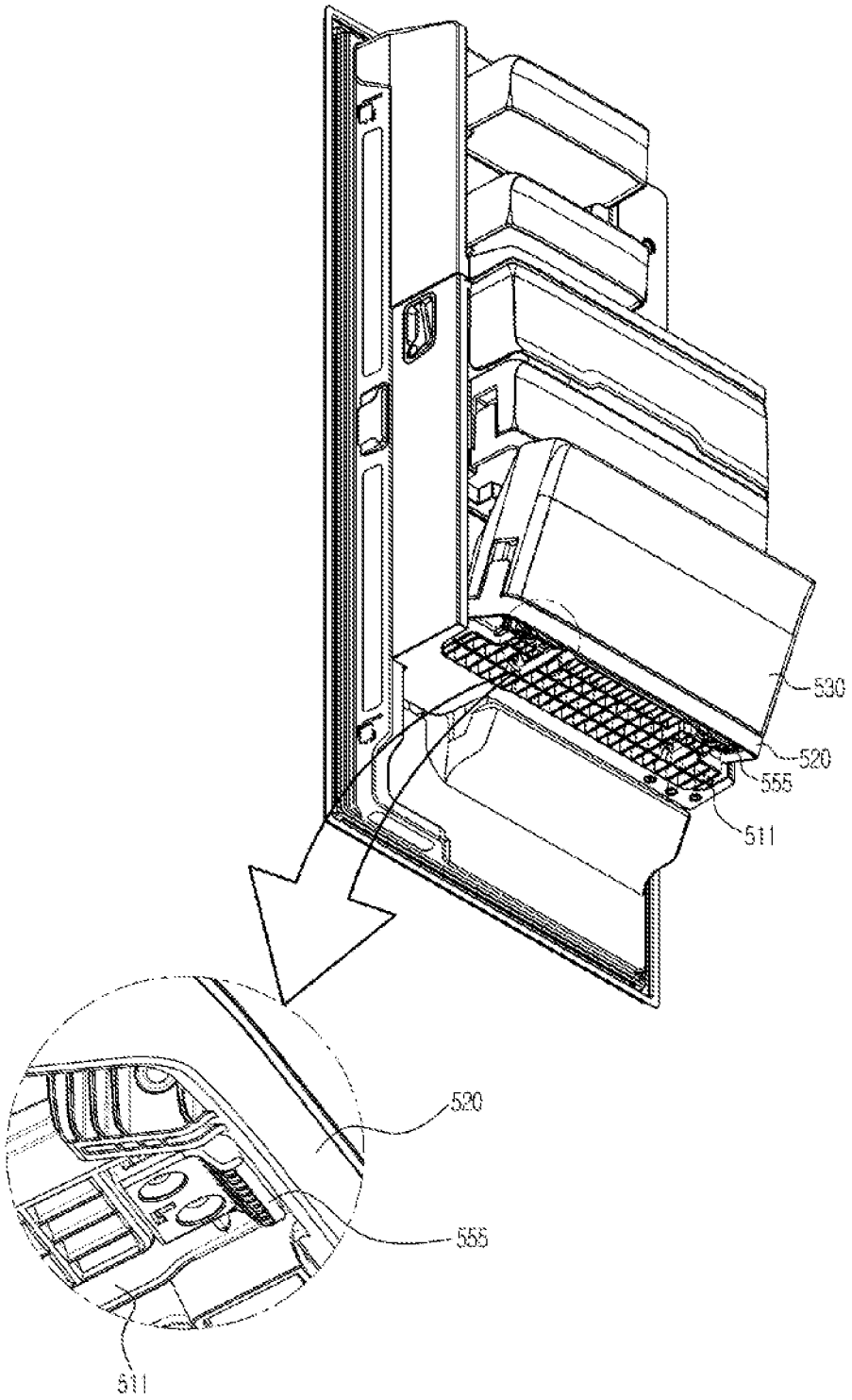

[Fig. 35]
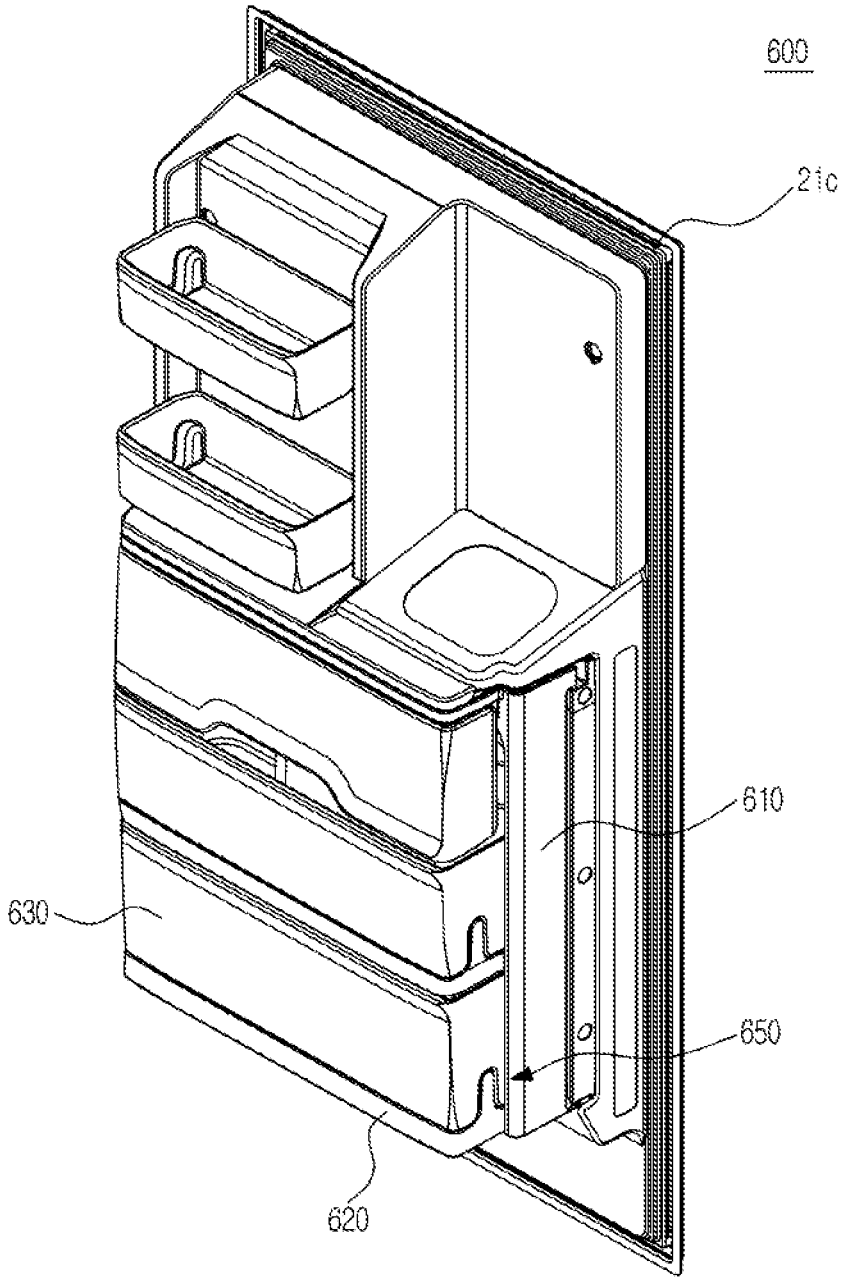

[Fig. 36]
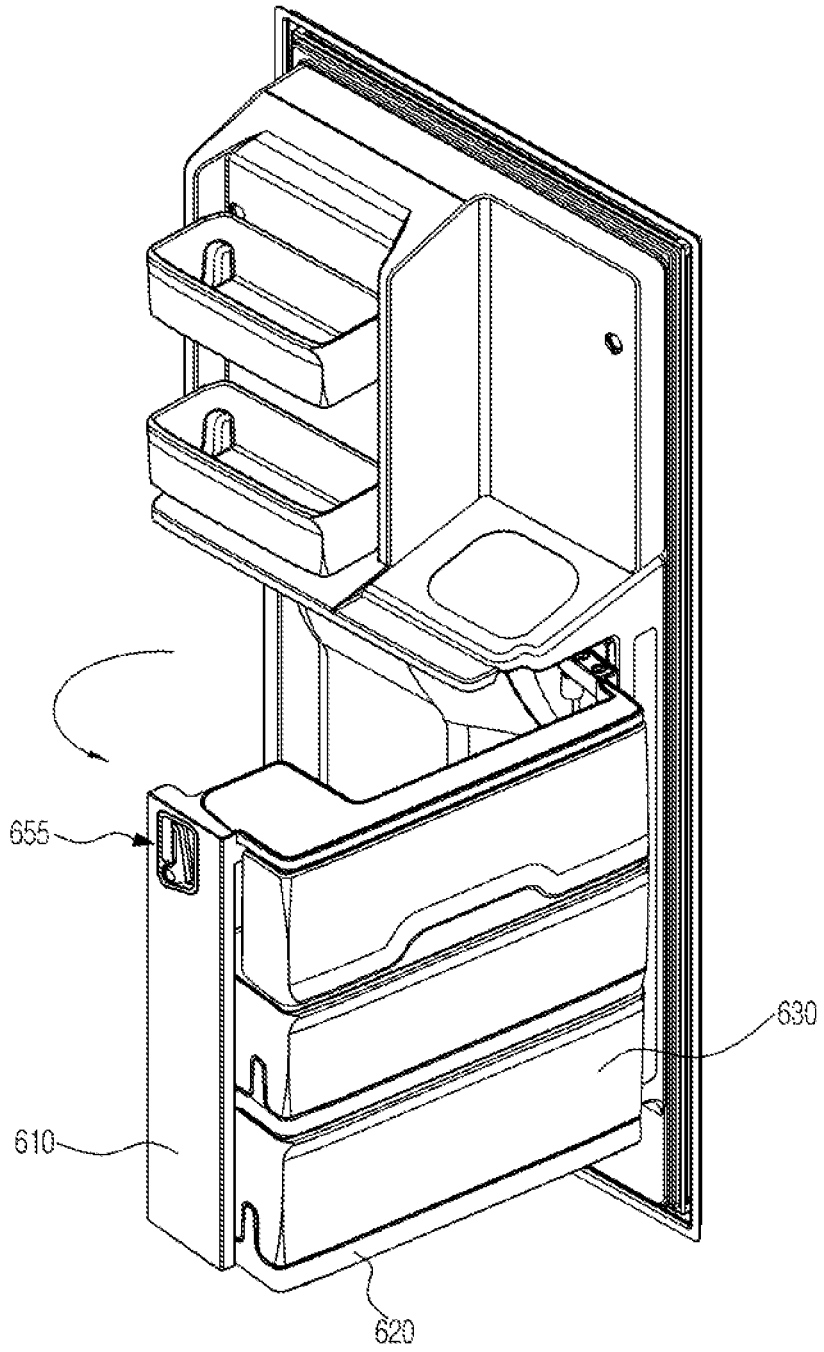

[Fig. 37]
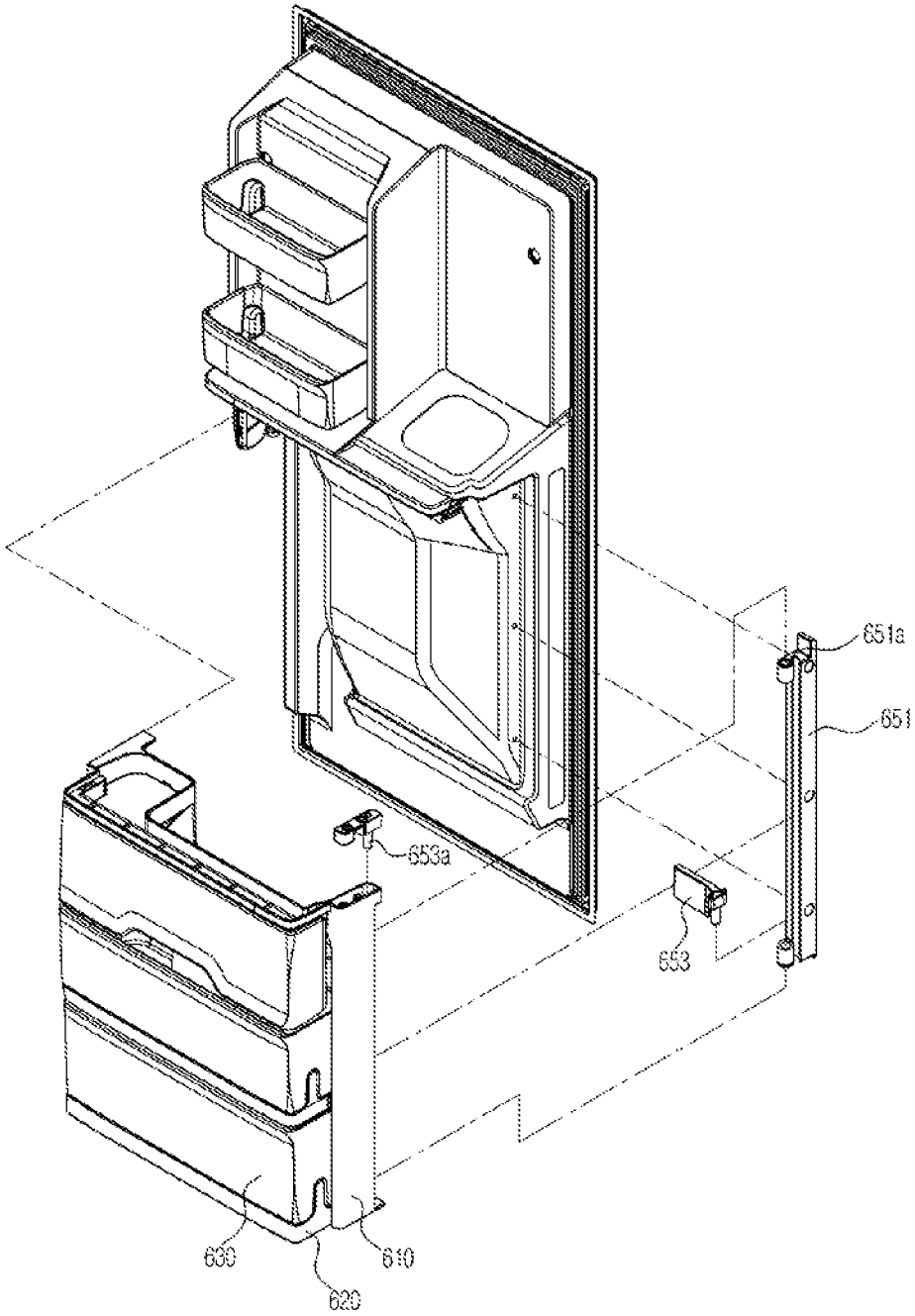

REFRIGERATOR

CROSS-REFERENCE TO RELATED APPLICATIONS

This application is a U.S. National Stage Application, which claims the benefit under 35 U.S.C. § 371 of PCT International Patent Application No. PCT/KR2015/000156, filed Jan. 7, 2015 which claims the foreign priority benefit under 35 U.S.C. § 119 of Korean Patent Application No. 10-2014-0002067, filed Jan. 7 2014, and Korean Patent Application No. 10-2014-0106067, filed Aug. 14, 2014, the contents of which are incorporated herein by reference.

TECHNICAL FIELD

The present disclosure relates to a refrigerator including a display unit to display the state of the refrigerator.

BACKGROUND ART

In general, a refrigerator is an electronic appliance including a storage room for storing food and a cool-air supply apparatus for supplying cool-air to the storage room to keep food fresh. The storage room is closed or opened by a door, and the door may include a display unit for displaying operation information of the refrigerator or receiving operation commands for operating the refrigerator.

Recently, a refrigerator in which a display unit is hidden in the inside of a door has been developed in order to improve a sense of beauty of the outer appearance. The front plate of the door is configured to transmit information displayed on the display unit to the outside. A configuration in which information displayed on the display unit can be transmitted to the outside depends on a material of the door.

DISCLOSURE

Technical Problem

An aspect of the present disclosure is to provide a refrigerator in which an input member is separated from a display member in a refrigerator door having a front plate made of a metal material and a display unit hidden therein.

Another aspect of the present disclosure is to provide a refrigerator having a dispenser, the refrigerator including a lever unit to control supply of mineral water.

Another aspect of the present disclosure is to provide a refrigerator including a door to facilitate coupling of components.

Another aspect of the present disclosure is to provide a refrigerator including a door capable of rotating a guide assembly installed therein.

Technical Solution

In accordance with an aspect of the present disclosure, a refrigerator includes a main body, a storage room formed in the inside of the main body, a door including a front plate which is made of a steel material and in which a plurality of through holes forming a predetermined shape are formed, the door configured to open or close the storage room, a display unit disposed in the inside of the door, and including a display member in which a display element having a shape corresponding to the plurality of through holes and facing the plurality of through holes is formed, and an input member separated from the display unit, and configured to receive an operation command for operating the refrigerator.

The display unit may further include a display cover installed in the rear surface of the front plate, and configure to form accommodation space for accommodating the display member behind the plurality of through holes.

The door may further include a upper cap forming the upper surface of the door, the upper cap may have an inlet hole through which the display member enters the accommodation space.

The display cover may have an open front part so that light emitted from the display member is irradiated towards the plurality of through holes.

The display unit may further include a front cover positioned between the display member and the rear surface of the front plate, the front cover may have a plurality of connection holes corresponding to the plurality of through holes.

The front cover may include a cover guide part at both sides, and the cover guide part may guide the display member so that the display member is closer to the front cover at the lower portion of the cover guide part.

The front plate may be rounded to protrude forward so that the front surface of the front cover has a shape corresponding to the front plate.

The input member may be disposed in another door which is different from the door in which the display unit is disposed.

The refrigerator may further include a controller configured to control the refrigerator according to the operation command received from the input member, and a connection member configured to transfer an electrical signal for the operation command generated by the input member to the controller, wherein the connection member may be connected to the controller located outside the door through a hinge coupled with the door in which the input member is disposed.

The predetermined shape of the plurality of through holes may include at least one of a picture, a letter, a figure, and a symbol.

In accordance with another aspect of the present disclosure, a refrigerator includes a main body, a storage room formed in the inside of the main body, a door configured to open or close the storage room, and having a front part in which a plurality of through holes forming a predetermined shape are formed, a display unit disposed behind the plurality of through holes in the inside of the door, and including a display member configured to display information of the refrigerator, and an input unit configured to receive an operation command for operating the refrigerator, wherein the display unit further comprises a display cover installed in the inside of the door to form accommodation space in which the display member is disposed.

The display cover may have an open front part, and forms the accommodation space behind the plurality of through holes.

The door may include a front plate forming front and side surfaces of the door, having a front part in which the plurality of through holes are formed, and made of a steel material, a rear plate coupled with a rear part of the front plate, and forming a rear surface of the door, an upper cap coupled with a upper part of the front plate, and a lower cap coupled with a lower part of the front plate.

The front plate may be rounded to protrude forward.

The display unit may further include a front cover disposed between the front plate and the display unit, the front cover may have a plurality of connection holes corresponding to the plurality of through holes.

The front cover may have a front part corresponding to the front plate.

The front cover may include a cover guide part at both sides, and the cover guide part may guide the display member so that the display member is closer to the front cover at the lower portion of the cover guide part.

The predetermined shape of the plurality of through holes may include at least one of a picture, a letter, a figure, and a symbol.

The input member may be disposed in another door which is different from the door in which the display unit is disposed.

The refrigerator may further include a controller configured to control the refrigerator according to the operation command received from the input member, and a connection member configured to transfer an electrical signal for the operation command generated by the input member to the controller, wherein the connection member may be connected to the controller located outside the door through a hinge coupled with the door in which the input member is disposed.

Advantageous Effects

According to the technical concepts of the present disclosure, the front plate of the refrigerator may be made of a metal material, the display unit may be hidden in the inside of the door, and information displayed on the display unit may be transmitted to the outside through the through holes formed in the front plate. Accordingly, a sense of beauty of the refrigerator can be improved. Also, since the input member is separated from the display member, the touch sensitivity of the input member can be prevented from deteriorating.

According to the technical concepts of the present disclosure, a user can more conveniently obtain water, ice pieces, and mineral water selectively using the lever unit from the refrigerator having the dispenser.

According to the technical concepts of the present disclosure, since the components of the door can be easily coupled, the efficiency of an assembly process can increase, and product reliability can be improved.

According to the technical concepts of the present disclosure, since a rotatable guide assembly is included in the inside of the door, the space of the storage room can be efficiently used.

BRIEF DESCRIPTION OF THE DRAWINGS

FIG. 1 is a perspective view showing the outer appearance of a refrigerator according to an embodiment of the present disclosure.

FIG. 2 is a perspective view of the refrigerator of FIG. 1 when a upper storage chamber of the refrigerator opens.

FIG. 3 is a perspective view showing an embodiment of the lever unit of FIG. 1.

FIG. 4 is a side view for describing operation of a first lever of FIG. 3.

FIG. 5 is a side view for describing operation of a second lever of FIG. 3.

FIG. 6 is a side view for describing operation of a third lever of FIG. 3.

FIG. 7 is a perspective view of the mineral water producing apparatus of the refrigerator.

FIG. 8 is a conceptual view for describing a process in which the refrigerator of FIG. 1 produces water, ice pieces, and mineral water and supplies the water, ice pieces, and mineral water to the dispenser.

FIG. 9 is a schematic exploded perspective view showing a display unit and the door of the refrigerator according to an embodiment of the present disclosure.

FIG. 10 is a perspective view showing a front cover of FIG. 9.

FIG. 11 is a perspective view of a display member of FIG. 9.

FIG. 12 is a cross-sectional view of the door of the refrigerator of FIG. 9.

FIG. 13 is an exploded perspective view of the display member of the refrigerator of FIG. 9.

FIG. 14 is an enlarged view of the through holes formed in the front plate of the refrigerator of FIG. 9.

FIG. 15 is an enlarged view of the through holes formed in the front plate when the display member of the refrigerator of FIG. 9 is in a turned-off state.

FIG. 16 is a cross-sectional view cut along a line B-B' of FIG. 14.

FIG. 17 shows the input member provided in the refrigerator of FIG. 9.

FIG. 18 is a schematic exploded perspective view of a door of the refrigerator of FIG. 1.

FIG. 19 is an enlarged view of a connection member coupling hole formed in a front plate of the door of FIG. 18.

FIG. 20 is an enlarged view of the connection member of FIG. 18.

FIG. 21 shows the upper cap of FIG. 18 and a connection member coupling part of the upper cap.

FIG. 22 is a view for describing a process in which the connection member is coupled with the front plate of FIG. 18.

FIG. 23 is a view for describing a process in which the upper cap of FIG. 18 is coupled with the connection member.

FIG. 24 is a perspective view of a tilt guide assembly installed on the rear surface of the door.

FIG. 25 is an exploded perspective view showing a configuration of the tilt guide assembly of FIG. 24.

FIG. 26 is a bottom view of the tilt unit disposed in the bottom of the tilt guide assembly of FIG. 24.

FIG. 27 is a cross-sectional view showing the rotation adjusting member of the tilt unit of FIG. 25.

FIGS. 28, 29, and 30 are views for describing operation in which the tilt guide assembly of FIG. 24 is rotated by the tilt unit.

FIG. 31 is an exploded perspective view of a tilt guide assembly according to another embodiment of the present disclosure, as seen from above.

FIG. 32 is an exploded perspective view of the tilt guide assembly of FIG. 31, as seen from below.

FIGS. 33 and 34 are views for describing operation in which the tilt guide assembly of FIG. 31 is rotated by the tilt unit.

FIG. 35 is a perspective view showing a rotation guide assembly of the refrigerator 1 of FIG. 2.

FIG. 36 is an exploded perspective view of the rotation guide assembly of FIG. 35.

FIG. 37 is a view for describing operation in which the rotation guide assembly of FIG. 35 rotates.

BEST MODE

Hereinafter, preferred embodiments of the present disclosure will be described in detail.

FIG. 1 is a perspective view showing the outer appearance of a refrigerator according to an embodiment of the present disclosure, and FIG. 2 is a perspective view of the refrigerator of FIG. 1 when a upper storage chamber of the refrigerator opens.

Referring to FIGS. 1 and 2, a refrigerator 1 according to an embodiment of the present disclosure may include a main body 10, a plurality of storage chambers 20 and 30 formed in the inside of the main body 10, and a cool-air supply apparatus (not shown) configured to supply cool air to the storage chambers 20 and 30.

The main body 10 may include an inner case forming the storage chambers 20 and 30, an outer case coupled with the outer portion of the inner case to form the outer appearance of the refrigerator 1, and an insulation material disposed between the inner case and the outer case to insulate the storage chambers 20 and 30.

The storage chambers 20 and 30 may be partitioned into a refrigerating chamber 20 which is the upper one and a freezing chamber 30 which is the lower one, by an intermediate partition wall 11. The refrigerating chamber 20 may be maintained at temperature of about 3° C. above zero to keep food refrigerated, and the freezing chamber 30 may be maintained at temperature of about 18.5° C. below zero to keep food frozen. In the refrigerating chamber 20, one or more shelves 23 on which food can be put, and one or more storage boxes 27 to seal and store food may be provided.

Also, an ice-making room 81 for making ice may be provided in the upper corner of the freezing chamber 20 such that the refrigerating chamber 20 can be partitioned by an ice-making room case 82. In the ice-making room 81, an ice-making apparatus 80, such as an ice-making tray for making ice pieces, an ice bucket for storing ice pieces made by the ice-making tray, etc., may be provided.

Meanwhile, in the refrigerating chamber 20, a water tank 70 may be provided to store water. The water tank 70 may be disposed between the storage boxes 27, as shown in FIG. 2. However, the water tank 70 may be disposed at any other location as long as water stored in the water tank 70 can be cooled by cool air inside the refrigerating chamber 20.

The water tank 70 may be connected to an external water source 40 (see FIG. 8) such as a water pipe, and may store purified water filtered by a water filter 50 (see FIG. 8). In a water supply pipe connecting the water tank 70 to the external water source 40, a flow switching valve 60 may be provided so that water can be supplied to the ice-making apparatus 80 through the flow switching valve 60.

Each of the refrigerating chamber 20 and the freezing chamber 30 may include an open front part through which food is put or taken. The open front part of the refrigerating chamber 20 may be opened or closed by a pair of rotating doors 21 and 22 (also, referred to as refrigerating chamber doors 21 and 22) hinge-coupled with the main body 10. Also, the open front part of the freezing chamber 30 may be opened or closed by a pair of rotating doors 31 and 32 (also, referred to as freezing chamber doors 31 and 32) hinge-coupled with the main body 10. On the rear surfaces of the refrigerating chamber doors 21 and 22, one or more door guides 24 may be provided to store food.

Meanwhile, in the edges of the rear surfaces of the freezing chamber doors 21 and 22, a gasket (not shown) may be provided to seal space between the refrigerating chamber doors 21 and 22 and the main body 10 when the refrigerating chamber doors 21 and 22 close so as to prevent cool air from escaping from the refrigerating chamber 20. Also, in any one refrigerating chamber door 21 of the refrigerating chamber doors 21 and 22, a rotating bar may be provided to seal space between the refrigerating chamber doors 21 and 22 when the refrigerating chamber doors 21 and 22 close so as to prevent cool air from escaping from the refrigerating chamber 20.

Also, in any one refrigerating chamber door 21 of the refrigerating chamber doors 21 and 22, a dispenser 100 may be provided to enable a user to obtain water or ice pieces from the outside without opening the refrigerating chamber door 21.

The dispenser 100 may include water intake space 101 into which a user can insert a container such as a cup to obtain water or ice pieces, a control panel 102 (see FIG. 3) including one or more input buttons for making various settings of the dispenser 100 and a display for displaying various information of the dispenser 100, and a lever unit 110 for enabling the user to manipulate the dispenser 100 to selectively obtain water, ice pieces, and mineral water.

Also, the dispenser 100 may include an ice chute 103 (see FIG. 7) connecting the ice-making apparatus 80 to the water intake space 101 to supply ice pieces made in the ice-making apparatus 80 to the water intake space 101.

The water intake space 101 may be formed in the outer surface of the refrigerating chamber door 21. The ice chute 103 may be provided in the shape of a groove that is concave towards the inside of the refrigerating chamber 20, in the refrigerating chamber door 21.

The ice chute 103 may be positioned above the water intake space 101. The ice chute 103 may connect the water tank 70, the ice-making apparatus 80, and a mineral water producing apparatus 140, which are disposed in the inside of the refrigerating chamber 20, to the water intake space 101. Accordingly, the ice chute 103 may function as a passage through which water, ice pieces, and mineral water move from the inside of the refrigerating chamber 20 to the water intake space 101.

FIG. 3 is a perspective view showing an embodiment of the lever unit 110 of FIG. 1, FIG. 4 is a side view for describing operation of a first lever of FIG. 3, FIG. 5 is a side view for describing operation of a second lever of FIG. 3, and FIG. 6 is a side view for describing operation of a third lever of FIG. 3.

Referring to FIGS. 3 to 6, the lever unit 110 according to an embodiment of the present disclosure may include a lever unit body 111, an ice discharge part 112, a first lever 113, a second lever 114, and a third lever 115.

The lever unit body 111 may be coupled with the upper part of the dispenser 100. One ends of the first lever 113, the second lever 114, and the third lever 115 may be respectively coupled with the lever unit body 111. The lever unit body 111 may include a control panel 102 including a display at the front surface. The control panel 102 including the display can display information (for example, the state of the dispenser 100) of the refrigerator 1. However, the control panel 102 including the display may be disposed at another location than the lever unit body 111.

The lever unit body 111 may include the ice discharge part 112. The ice discharge part 112 may be provided in the center area of the lever unit body 111. The ice discharge part 112 may function as a passage through which water, mineral water, and ice pieces move from the inside of the refrigerating chamber 20 to the water intake space 101.

The first lever 113 may be disposed in the water intake space 101. The first lever 113 may be fixed at the lever unit body 101 at the upper end. The fixed upper end of the first lever 113 may be located behind the ice discharge part 112. The first lever 113 may extend downward from the fixed upper end.

The first lever 113 may be rotatable on the fixed upper end as an axis. The first lever 113 may be rotatable from a first position $D_{11}$ to a second position $D_{12}$. The first position $D_{11}$ may be ahead of the second position $D_{12}$. The first lever 113 may include a restoring member (not shown). The restoring member may move the first lever 113 located between the first position $D_{11}$ and the second position $D_{12}$ to the first position $D_{11}$. Accordingly, although the user moves the first lever 113 from the first position $D_{11}$, the first lever 113 may return to the first position $D_{11}$. The restoring member may include an elastic member.

According to an embodiment, the first lever 113 may be electrically connected to a controller 150 (see FIG. 8). The first lever 113 may transmit an electrical signal to the controller 150 whenever it moves to the first position $D_{11}$ or the second position $D_{12}$. The controller 150 may control the refrigerator 1 to perform predetermined operation according to a change in position of the first lever 113.

The second lever 114 may be disposed in the water intake space 101. The second lever 114 may be fixed at the lever unit body 111 at the upper end. The fixed upper end of the second lever 114 may be located behind the ice supplying unit 112. The fixed upper end of the second lever 114 may be positioned between the first lever 113 and the ice discharge part 112. The second lever 114 may extend downward from the fixed upper end. The lower end of the second lever 114 may be located higher than the lower end of the first lever 113. The length of the second lever 114, that is, the length from the upper end of the second lever 114 to the lower end of the second lever 114 may be shorter than the length of the first lever 113.

The second lever 114 may be rotatable on the fixed upper end as an axis. The second lever 114 may be rotatable from a third position $D_{21}$ to a fourth position $D_{22}$. The third position $D_{21}$ may be ahead of the fourth position $D_{22}$. The second lever 114 may include a restoring member (not shown). The restoring member may move the second lever 114 located between the third position $D_{21}$ and the fourth position $D_{22}$ to the third position $D_{21}$. Accordingly, although the user moves the second lever 114 from the third position $D_{21}$, the second lever 114 may return to the third position $D_{21}$. The restoring member may include an elastic member.

According to an example, the second lever 114 may be electrically connected to the controller 150. The second lever 114 may transmit an electrical signal to the controller 150 whenever it moves to the third position $D_{21}$ or the fourth position $D_{22}$. The controller 150 may control the refrigerator 1 to perform predetermined operation according to a change in position of the second lever 114.

The third lever 115 may be disposed in the water intake space 101. The third lever 115 may have a "U" shape. Both ends of the third lever 115 may be fixed at the same height. Both ends of the third lever 115 may be fixed at the lever unit body 111.

The third lever 115 may be rotatable on the fixed both ends as an axis. The third lever 115 may be rotatable from a fifth position $D_{31}$ to a sixth position $D_{32}$. The fifth position $D_{31}$ may be higher than the sixth position $D_{32}$. The third lever 115 may be fixed at the fifth position $D_{31}$ or at the sixth position $D_{32}$. If the third lever 115 escapes from the fifth position $D_{31}$, the third lever 115 may automatically move to the sixth position $D_{32}$. Also, if the third lever 115 escapes from the sixth position $D_{32}$, the third lever 115 may automatically move to the fifth position $D_{31}$.

According to an example, the third lever 115 may be electrically connected to the controller 150. The third lever 115 may transmit an electrical signal to the controller 150 whenever it moves to the fifth position $D_{31}$ or the sixth position $D_{32}$. The controller 150 may control the refrigerator 1 to perform predetermined operation according to a change in position of the third lever 115.

Meanwhile, in the rear surface of the refrigerating chamber door 21 in which the dispenser 100 of the refrigerator 1 according to an embodiment of the present disclosure is disposed, the mineral water producing apparatus 140 may be disposed to produce mineral water. The mineral water producing apparatus 140 may produce mineral water in the inside of the refrigerator 1.

FIG. 7 is a perspective view of the mineral water producing apparatus 140 of the refrigerator 1, and FIG. 8 is a conceptual view for describing a process in which the refrigerator 1 of FIG. 1 produces water, ice pieces, and mineral water and supplies the water, ice pieces, and mineral water to the dispenser 100.

Referring to FIGS. 7 and 8, water may be supplied from the external water source 40. The water may move from the external water source 40 to the water filter 50, and then be purified by the water filter 50. The purified water may move from the water filter 50 to the flow switching valve 60. The flow switching valve 60 may move the purified water to the ice-making apparatus 80 and the water tank 70, selectively. Ice pieces may be made from water moved to the inside of the ice-making room 81.

Water moved to the water tank 70 may move to a valve assembly 145 through a purified water supply path 70*a*. The purified water may move from the valve assembly 145 to a mineral water tank 141 through a purified water supply valve 145*a*, or to the water intake space 101 of the dispenser 100 through a purified water supply valve 145*b*. The water moved to the mineral water tank 141 may be combined with carbon dioxide moved to the mineral water tank 141 through a separate flow path to produce mineral water.

The carbon dioxide may be stored in a carbon dioxide gas cylinder 142. According to an example, the carbon dioxide gas cylinder 142 may be replaced with new one. If carbon dioxide stored in the carbon dioxide gas cylinder 142 is all consumed, the carbon dioxide gas cylinder 142 may be replaced with new one to supply carbon dioxide.

The carbon dioxide may move from the carbon dioxide gas cylinder 142 to the mineral water tank 141 through a carbon dioxide supply path 142*a*. In the carbon dioxide supply path 142*a*, a carbon dioxide supply valve 142*b* may be provided. The carbon dioxide supply valve 142*b* may adjust the amount of carbon dioxide passing through the carbon dioxide supply path 142*a*. Carbon dioxide may be supplied to water stored in the mineral water tank 141 through the carbon dioxide supply path 142*a*. Through the above-described process, mineral water may be produced.

The mineral water may move to the valve assembly 145 through a mineral water supplying path 141*a*. In the valve assembly 145, a mineral water supply valve 145*c* may control mineral water that is provided to the dispenser 100.

According to an example, the controller 150 may be electrically connected to the lever unit 110, the valve assembly 145, and the ice-making apparatus 80. The lever unit 110 may transfer operation signals of the first lever 113, the second lever 1143, and the third lever 115 to the controller 150. The controller 150 may control the valve assembly 145 and the ice-making apparatus 80 to operate, according to the signals received from the lever unit 110.

The controller 150 may control the valve assembly 145 to adjust the purified water supply valve 145*b* and the mineral water supply valve 145*c* to selectively provide one(s) of mineral water, purified water, and ice pieces to the water intake space 101.

According to an example, the third lever 115 may control supply of mineral water. If the third lever 115 is at the third position $D_{31}$, the controller 150 may shut off the mineral water supply valve 145*c*. At this time, if the first lever 113 moves to the second position $D_{12}$, the controller 150 may control water to move to the water intake space 101. Also, if the second lever 114 moves to the fourth position $D_{22}$, the controller 150 may control ice pieces to move to the water intake space 101.

Also, if the third lever 115 is at the sixth position $D_{32}$, the controller 150 may open the mineral water supply valve 145*c*. At this time, if the first lever 113 moves to the second position $D_{12}$ or the second lever 114 moves to the fourth position $D_{22}$, the controller 150 may control mineral water to move to the water intake space 101.

Unlike this, when the third lever 115 is at the sixth position $D_{32}$, the controller 150 may control water to move to the water intake space 101 if the first lever 113 moves to the second position $D_{12}$, and if the second lever 114 moves to the fourth position $D_{22}$, the controller 150 may control mineral water to move to the water intake space 101.

Also, when the third lever 115 is at the sixth position $D_{32}$, the controller 150 may control mineral water to move to the water intake space 101 if the first lever 113 moves to the second position $D_{12}$, and if the second lever 114 moves to the fourth position $D_{22}$, the controller 150 may control ice pieces to move to the water intake space 101.

Hereinafter, a door including a display unit according to an embodiment of the present disclosure will be described.

FIG. 9 is a schematic exploded perspective view showing a display unit and the door 21 of the refrigerator 1 according to an embodiment of the present disclosure, FIG. 10 is a perspective view showing a front cover of FIG. 9, FIG. 11 is a perspective view of a display member of FIG. 9, and FIG. 12 is a cross-sectional view of the door 21 of the refrigerator 1 of FIG. 9.

Referring to FIGS. 9 to 12, the door 21 may be constituted by combining a front plate 21*a* forming the front and side surfaces of the door 21, a rear plate 21*b* coupled with the rear part of the front plate 21*a* and forming the rear part of the door 21, and a upper cap 21*c* and a lower cap 21*d* to respectively seal the upper and lower areas of inside space formed between the front plate 21*a* and the rear plate 21*b*.

The front plate 21*a* may be bent such that a single plate material forms the front and side surfaces of the door 21. The front plate 21*a* may be rounded such that the front surface protrudes forward.

The front plate 21*a* may be made of a metal material, such as steel, aluminum, an alloy, PCM, VCM, or the like. The front plate 21*a* may have high strength compared to a tempered glass plate or a resin plate, and offer a feeling of exclusivity, due to metal material characteristics. The front plate 21*a* can further enhance a sense of beauty through surface treatment which is distinctive of the metal material.

That is, hair lining, mirror machining, bead blasting, etc. may be performed on the surface of the front plate 21*a*. At this time, one of the above-mentioned processes may be performed on the surface of the front plate 21*a*.

Alternatively, all of the above-mentioned processes may be performed on the front plate 21*a*. That is, the front plate 21*a* may have all of a hair-line pattern, a gloss, and beads. In this case, the front plate 21*a* may be processed in the order of mirror machining, hair lining, and bead blasting.

According to an example, in an area of the front part of the front plate 21*a*, a plurality of through holes 229 may be formed. The plurality of through holes 229 may be arranged to form a predetermined shape. The predetermined shape may be at least one of a picture, a letter, a figure, and a symbol. The plurality of through holes 229 may represent information such as an operation state of the refrigerator 1 according to light generated from a display unit 200 which will be described later.

The rear plate 21*b* may be coupled with both sides of the front plate 21*a*. The rear plate 21*b* may be vacuum-molded with a resin material. The rear plate 21*b* may have a dike protruding backward so that a door guide can be installed therein.

The upper cap 21*c* and the lower cap 21*d* may be injection-molded with a resin material. After the front plate 21*a*, the rear plate 21*b*, the upper cap 21*c*, and the lower cap 21*d* are combined with each other, foaming solution of an insulation material may be injected into the inside space to make foam in the inside space.

The upper cap 21*c* may include an inlet hole 213. The inlet hole 213 may function as a passage through which the display unit 200 can enter the inside of the door 21.

The upper cap 21*c* may further include an upper cap cover 214. The upper cap cover 214 may be used to open or close the inlet hole 213. According to the above-described configuration, the display unit 200 can be installed in the inside of the door 21 so as not to be exposed to the outside.

Between the front plate 21*a* and the rear plate 21*b*, foaming space 21*e* in which an insulation material 39 makes foam may be formed. The insulation material 39 may be used to insulate the storage chamber 20, and may be urethane. After the foaming solution of the insulation material makes foam in the foaming space 21*e*, the front plate 21*a*, the rear plate 21*b*, the upper cap 21*c*, and the lower cap 21*d* may be firmly coupled with each other by the adhesive force of the foaming solution.

The refrigerator 1 according to an embodiment of the present disclosure may further include the display unit 200. The display unit 200 may be disposed in the inside of the door 21. The display unit 200 may face the through holes 229 in the inside of the door 21. The display unit 200 may generate light, and the generated light may be displayed as a letter, a figure, a picture, a sign, etc. through the through holes 229. Thereby, the display unit 200 can display information such as operation information of the refrigerator 1.

According to an embodiment of the present disclosure, the display unit 200 may include a display cover 210, a front cover 220, and a display member 230.

The display cover 210 may be installed behind the front plate 21*a*. The display cover 210 may face the through holes 229 behind the front plate 21*a*. The front part of the display cover 210 may open to transmit light generated from the display member 230 to the through holes 229.

The display cover 210 may be coupled with the front plate 21*a* so as to form accommodate space 211 thereinside. The display cover 210 may be provided to accommodate the front cover 220 and the display member 230 in the accommodate space 211.

The rear part of the display cover 210 may be closer to the front plate 21*a* at the lower portion. That is, the accommodation space 211 of the display cover 210 may have a smaller width in the front-back direction at the lower area. Accordingly, the display cover 210 may enable the display member 230 moving into the accommodation space 211 to approach close to the front plate 21*a*.

The display cover 210 may include a fixing protrusion 212 for fixing the display member 230 on the inner surface. The fixing protrusion 212 may press the display member 230 inserted into the accommodate space 211 in the front direction. The fixing protrusion 212 may be made of a member having a restoring force to press the display member 230 positioned in the accommodation space 211 in the front direction.

The front cover 220 may be installed in the accommodation space 211 of the display cover 210. The front cover 220 may face the plurality of through holes formed in the front plate 21*a*.

In the front cover 220, a plurality of connection holes 225 may be formed to correspond to the plurality of through holes 229. The plurality of connection holes 225 may function as passages through which light generated from the display member 230 can move in the front direction towards the front plate 21*a*.

The front cover 220 may be disposed between the display member 230 and the front plate 21*a*. The front cover 220 may have a shape corresponding to space formed between the rounded front plate 21*a* protruding forward and the display member 230 whose front surface is flat. The front cover 220 may contact the front plate 21*a* at the front surface, and contact the display member 230 at the rear surface. Accordingly, the front cover 220 can remove space made between the front plate 21*a* and the display member 230.

The front cover 220 may include a cover front plate 221, a cover side plate 222, and a cover guide part 223.

The cover front plate 221 may have a shape corresponding to the space formed between the rounded front plate 21*a* protruding forward and the display member 230 whose front surface is flat. Accordingly, the front cover 220 may contact the front plate 21*a* at the front surface, and contact the display member 230 at the rear surface.

In the cover front plate 221, the plurality of connection holes 225 may be formed. As described above, the plurality of connection holes 225 of the cover front plate 221 may face the plurality of through holes 229.

The cover side plate 222 may extend backward from both side edges of the cover front plate 221. The cover side plate 222 may be formed by bending the cover front plate 221.

The cover guide part 223 may be formed by bending one end of the cover side plate 222 inwardly. The cover guide part 223 may guide the display member 230 to closely contact the front cover 220 when the display member 230 moves into the accommodation space 211.

According to an example, the cover side plate 222 may have a smaller width at the lower portion. The cover guide part 223 may be formed along the rear end of the cover side plate 222 so as to have a shorter distance to the cover front plate 221 at the lower portion. Accordingly, the cover side plate 222 and the cover guide part 223 may guide the display member 230 to closely contact the front cover 220 when the display member 230 moves into the accommodation space 211.

The display member 230 may generate light to display a predetermined shape. The display member 230 may face the plurality of through holes 229 of the front plate 21*a* in the inside of the door 21.

FIG. 13 is an exploded perspective view of the display member 230 of the refrigerator 1 of FIG. 9.

Referring to FIG. 13, the display member 230 may include a display device 239 to generate light. The display device 239 may include a cover sheet 231, a light source unit 233 to emit light, and a guide part 232 to guide light emitted from the light source unit 233 to a display element 231*b*.

The cover sheet 231 may include the display element 231*b* to display operation information of the refrigerator 1 by being brightened or darkened, and a blocking unit 231*a* that is maintained relatively dark. The display element 231*b* may be made of a transparent material or a fluorescent material, and the blocking unit 231*a* may be made of an opaque material.

The cover sheet 231 may be separated from the guide part 232, and adhered on one surface of the guide part 232.

The display element 231*b* may be configured with any one or a combination of a picture, a letter, a figure, a symbol, and a segment constituting a part of them for displaying operation information of the refrigerator 1. Accordingly, if light is irradiated to the cover sheet 231, the picture, letter, figure, symbol, etc. of the display element 231*b* may be illuminated so as to display operation information of the refrigerator 1. The display element 231*b* may have a shape corresponding to the plurality of through holes 229 formed in the front plate 21*a* and the plurality of connection holes 225 formed in the front cover 220.

The light source unit 223 may include a Light Emitting Diode (LED) to emit light. There may be provided a plurality of LEDs 234 that can be independently controlled.

The guide part 232 may guide light emitted from the LEDs 234 to be directed towards the cover sheet 231. The guide part 232 may include a guide body part 232*a* made of a light reflecting material, and a plurality of guide holes 232*b* penetrating the guide body part 232*a*. The guide holes 232 may have greater diameters at their portions closer to the cover sheet 231 from the LEDs 234, as shown in FIG. 12.

FIG. 14 is an enlarged view of the through holes 229 formed in the front plate 21*a* of the refrigerator 1 of FIG. 9, FIG. 15 is an enlarged view of the through holes 229 formed in the front plate 21*a* when the display member 230 of the refrigerator 1 of FIG. 9 is in a turned-off state, and FIG. 16 is a cross-sectional view cut along a line B-B' of FIG. 14.

Referring to FIGS. 14, 15, and 16, if the display unit 200 hidden in the inside of the door 21 displays predetermined information, the predetermined information may be displayed through the plurality of through holes 229 formed in the front plate 21*a* of the door 21, as shown in FIG. 14.

Each of the through holes 229 formed in the front plate 21*a* may have a diameter of preferably about 0.1 mm to 0.5 mm, and a distance between the through holes 229 may be in the range of about 0.3 mm to 1.5 mm. The through holes 229 can be observed with a users naked eyes. Also, the thickness of the front plate 21*a* is assumed to be 0.6 mm or less.

The through holes 229 may be formed through etching or laser drilling. The through holes 229 having a diameter in the range of 0.3 mm to 0.4 mm may be preferably formed by etching having a high degree of precision.

Also, the through holes 229 having a diameter of 0.2 mm or smaller may be preferably formed by laser drilling although thermal deformation or burr may be more or less generated. Meanwhile, if the diameter of the through holes 229 is too great, discrimination may be lowered. Accordingly, the diameter of the through holes 229 may be preferably 0.2 mm or smaller.

That is, the through holes 229 may be arranged to form shapes of a picture 229*a*, a letter 229*b*, a figure segment 229*c*, etc., respectively corresponding to a picture, a letter, a figure segment, etc. of the display element 231*b*. Accordingly, if the LEDs 234 emit light so that a predetermined picture, a predetermined letter, a predetermined figure, a predetermined symbol, etc. are displayed on the display unit 200, the predetermined picture, the predetermined letter, the predetermined figure, the predetermined symbol, etc. may be displayed on the front plate 21*a* of the door 21.

Referring again to FIG. 11, the display member 230 may further include a display member handle part 235. The display member handle part 235 may be disposed in the upper portion of the display member 230. The display member handle part 235 may allow a user to grip the display member 230. Accordingly, the user may grip the display member handle part 235 to put the display member 230 into the inside of the door 21.

The display member 230 may further include a plurality of display member guide parts 237 at its side edges. The display member guide parts 237 may be respectively disposed at both side edges of the display member 230. The display member guide parts 237 may cause the display member 230 to closely contact the front cover 220 along the cover guide parts 223 of the front cover 220.

According to an example, one ends of the display member guide parts 237 may be disposed at the front portions of the lower ends of both side edges of the display member 230, and the other ends of the display member guide parts 237 may be disposed at the rear portions of the upper ends of the both side edges of the display member 230. The display member guide parts 237 may be closer to the front surface of the display member 230 at the lower portions. The display member guide parts 237 may have a shape corresponding to the cover guide parts 223 of the front cover 220.

The refrigerator 1 may further include an input member 270. The input member 270 may allow the user to input an operation command for operating the refrigerator 1.

FIG. 17 shows the input member 270 provided in the refrigerator 1 of FIG. 9.

Referring to FIG. 17, in the refrigerator 1 according to an embodiment of the present disclosure, the input member 270 may be separated from the display member 230. The input member 270 may be installed in another door 32 that is different from the door 21 in which the display member 230 is installed. According to an example, the input member 270 may be installed in a part of the lower door 32, and the display member 230 may be installed in the upper door 21.

The input member 270 may be installed at the upper surface of the lower door 32. The input member 270 may be disposed on the upper cap 32*a* of the lower door 32. Accordingly, the input member 270 may enable a user to input a command when the lower door 32 opens. Alternatively, the input member 270 may be disposed on the front surface of the lower door 32 or a side surface of the lower door 32.

The input member 270 may receive a command for operating the refrigerator 1. The input member 270 may use a capacitive touch sensing method. For example, the input member 270 may include a sensor of measuring a change in charges according to a user's touch input.

The sensor can measure a change in charges flowing through the touch button 271 when a user touches a specific area corresponding to the location of the touch button 271, thereby determining whether a touch input is made. The input member 270 may use another method well-known in the art, such as a pressure sensing method, a dome switch method, and a proximity sensor method (for example, a Infrared (IR) method), other than the capacitive touch sensing method.

Although not shown in the drawings, the refrigerator 1 may further include a controller configured to control the refrigerator 1 according to an operation command received from the input member 270, and a connection member configured to transfer an electrical signal about the operation command generated by the input member 270 to the controller 150.

The connection member may connect the door 32 in which the input member 270 is disposed to the controller 150 located outside the door 32 through a hinge coupled with the main body 10. Accordingly, an operation command input by the user through the input member 270 may be converted into an electrical signal, and then transferred to the controller through the connection member.

If the input member 270 is disposed in the same door in which the display unit 200 is disposed, the sensitivity of the input member 270 may deteriorate. Particularly, if the front plate 21*a* of the door 21 is made of a metal material, like the present disclosure, the sensitivity of the input member 270 may deteriorate due to the display unit 200.

For this reason, according to the present disclosure, the input member 270 may be separated from the display unit 200 so as to prevent the sensitivity of the input member 270 from deteriorating.

A method of forming the through holes 229 in the front plate 21*a* of the door 21 and disposing the display member 230 in the inside of the door 21 such that the display member 230 is hidden, as described above, can be applied to other kitchen electronic appliances such as a cooking appliance, as well as a refrigerator.

FIG. 18 is a schematic exploded perspective view of a door of the refrigerator 1 of FIG. 1, and FIG. 19 is an enlarged view of a connection member coupling hole formed in a front plate of the door of FIG. 18.

Referring to FIGS. 18 and 19, a door 300 according to an embodiment of the present disclosure may include a front plate 310, a rear plate 320, a upper cap 330, a lower cap 340, and a plurality of connection members 350.

The front plate 310 may form the front and side surfaces of the door 300. The front plate 310 may be made of a metal material, such as steel, aluminum, an alloy, PCM, VCM, or the like. The front plate 310 may be formed by bending a plate material to form the front and side surfaces of the door 300.

The front plate 310 may include a first front plate coupling part 312 bent from the upper end to the inside of the door 300, and a second front plate coupling part 313 extending vertically downward from the first front plate coupling part 312. The first front plate coupling part 312 and the second front plate coupling part 313 may be formed by bending a single plate material.

According to an example, the front plate 310 may include a connection member coupling hole 315. The connection member coupling hole 315 may be formed in the second front plate coupling part 313. There may be provided a plurality of second front plate coupling parts 313. Also, a plurality of connection member coupling holes 315 may be formed at regular intervals in the second front plate coupling parts 313.

Referring again to FIG. 18, the rear plate 320 may be coupled with the rear part of the front plate 310 to form the rear part of the door 300. The rear plate 320 may be vacuum-molded with a resin material. The rear plate 320 may have a dike (not shown) protruding backward so that a door guide can be installed therein.

The upper cap 330 and the lower cap 340 may seal the upper and lower areas of inside space formed between the front plate 310 and the rear plate 320. The upper cap 330 and the lower cap 340 may be injection-molded with a resin material. According to an embodiment of the present disclosure, the upper cap 330 and the lower cap 340 may be respectively coupled with the connection members 350 to respectively seal the upper and lower areas of the inside space formed between the front plate 310 and the rear plate 320.

Hereinafter, the upper cap 330 and the connection member 350 sealing the upper end of the door 300 will be described in detail.

FIG. 20 is an enlarged view of the connection member 350 of FIG. 18.

Referring to FIG. 20, the connection member 350 may include a first connection member groove 352, a second connection member groove 355, a front plate catching part 353, and a upper cap coupling hole 357. The connection member 350 may be fixed at the inner upper end of the front plate 310.

The first connection member groove 352 may be formed along the upper, outer surface of the connection member 350. The first connection member groove 352 may be formed at a location at which the second front plate coupling part 313 of the front plate 310 can be inserted. The first connection member groove 352 may be formed at the inner area of the upper surface of the connection member 350, spaced by the width of the first front plate coupling part 312 from the edge of the upper surface of the connection member 350.

The first connection member groove 352 may have the front plate catching part 353 on the inner side surface. According to an example, a plurality of front plate catching parts 353 may be provided to correspond to the number of the connection member coupling holes 315. When the connection member 350 is fixed at the upper inner end of the front plate 310, the front plate catching parts 353 may be disposed at locations overlapping the connection member coupling holes 315. The connection member 350 may be coupled with the front plate 310 when the connection member coupling holes 315 are caught by the lower ends of the front plate catching parts 353.

According to an example, the front plate catching parts 353 may have the smaller thickness at the upper portions. Accordingly, the connection member coupling holes 315 may move from top to bottom to be able to be easily coupled with the front plate catching parts 353.

The second connection member groove 355 may be formed in the upper surface of the connection member 350. The second connection member groove 355 may be formed in the inner area than the first connection member groove 352 with a predetermined distance from the first connection member groove 352.

According to an example, in the inner surface of the second connection member groove 355, a upper cap coupling hole 357 may be formed. The upper cap coupling hole 357 may be formed in the lower surface of the second connection member groove 355. A plurality of upper cap coupling holes 357 may be formed at regular intervals in the inner surface of the second connection member groove 355. The upper cap 330 may be coupled with the inner surface of the second connection member groove 355.

FIG. 21 shows the upper cap 330 of FIG. 18 and a connection member coupling part of the upper cap 330.

Referring to FIG. 21, the upper cap 330 may include a connection member coupling part 332 that is inserted into the second connection member groove 355. The connection member coupling part 332 may extend downward from the front and side parts of the upper cap 300 facing the front plate 310. The connection member coupling part 332 may extend from the upper cap 330 with the same length as the depth of the second connection member groove 355.

According to an example, the connection member coupling part 332 may have a connection member catching part. According to an example, a plurality of connection member catching parts 333 may be provided to correspond to the number of the upper cap coupling holes 357.

According to an example, the connection member catching part 333 may have the greater thickness at the upper portion. Accordingly, the connection member catching part 333 may move downward to be able to be easily coupled with and fixed at the upper cap coupling hole 357 of the connection member 350.

The connection member catching part 333 may be disposed at a location overlapping the upper cap coupling hole 357 when the upper cap 330 closes the upper part of the door 300. The upper cap 310 may be coupled with the connection member 350 when the upper cap coupling hole 357 is caught by the upper end of the connection member catching part 333. The upper cap 310 may be coupled with the connection member 350 to seal the upper end of the door 300.

Hereinafter, a process in which the upper cap 330 is installed to close the upper end of the door 300, according to an embodiment of the present disclosure will be described.

FIG. 22 is a view for describing a process in which the connection member 350 is coupled with the front plate 310 of FIG. 18, and FIG. 23 is a view for describing a process in which the upper cap 330 of FIG. 18 is coupled with the connection member 350.

Referring to FIG. 22, the connection member 350 may be coupled with the front plate 310. The connection member 350 may be coupled with and fixed at the upper inner end of the front plate 310.

According to an example, the connection member 350 may be coupled with the front plate 310 when the front plate catching part 353 is caught by the connection member coupling hole 315 of the front plate 310. Since the front plate catching part 353 is disposed at a location overlapping the connection member coupling hole 315, as described above, the front plate catching part 353 may be caught by the connection member coupling hole 315 of the front plate 310 by moving the connection member 350 from the lower portion to the upper portion of the front plate 310. At this time, a part of the second front plate coupling part 313 of the front plate 310 may be inserted into the inside of the first connection member groove 352 of the connection member 350. More specifically, the second front plate coupling part 313 of the front plate 310 may be inserted into the first connection member groove 352 of the connection member 350, and the front plate catching part 353 may be coupled with the connection member coupling hole 315 of the front plate 310 so that the connection member 350 can be coupled with and fixed at the upper inner end of the front plate 310.

Referring to FIG. 23, the upper cap 330 may be coupled with the connection member 350 fixed at the front plate 310.

According to an example, the upper cap 330 may be coupled with the connection member 350 when the connection member catching part 333 is caught by the upper cap coupling hole 357 of the connection member 350. Since the connection member catching part 333 is disposed at a location overlapping the upper cap coupling hole 357, as described above, the connection member catching part 353 may be caught by the upper cap coupling hole 357 of the connection member 350 by moving the upper cap 330 from the upper portion to the lower portion of the connection member 350. At this time, the connection member coupling part 332 of the upper cap 330 may be inserted into the inside of the second connection member groove 355 of the connection member 350. More specifically, the connection member coupling part 332 may be inserted into the second connection member groove 355, and the connection member catching part 333 may be coupled with the upper cap coupling hole 357 of the upper member 350 so that the upper cap 330 can be coupled with and fixed at the connection member 350.

As described above, in the door 300 according to an embodiment of the present disclosure, since the upper cap 330 is coupled with the front plate 310 through the connection member 350, it is possible to prevent deformation, cracking, and loosening of the door 300, unlike when the front plate 310 and the upper cap 330 are assembled by a press fit method.

Also, since the door 300 can be efficiently assembled, productivity and product reliability can be improved.

The above description relates to a process in which the upper cap 330 is coupled with the front plate 310 of the door 300 through the connection member 350. However, the lower cap 340 can be also coupled with the front plate 310 of the door 300 through the connection member 350 in the same process. Also, in all of the upper doors 21 and 22 and the lower doors 31 and 32 of the refrigerator 1, the upper cap 330 or the lower cap 340 may be coupled with the front plate 310 through the connection member 350, as described above.

FIG. 24 is a perspective view of a tilt guide assembly installed on the rear surface of the door 300, and FIG. 25 is an exploded perspective view showing a configuration of the tilt guide assembly of FIG. 24.

Referring to FIG. 24, a tilt guide assembly 400 may include a tilt body part 410, one or more trays 420, a guide unit 430, and a tilt unit 450. The tilt guide assembly 400 may be installed on the rear surface of the door 300 to be positioned in the inside of the refrigerating chamber 20 when the door 300 closes.

The tilt body part 410 may be coupled with the rear surface of the door 300. The rear surface of the tilt body part 410 may contact the rear plate 21*b* of the door 300. The tilt body part 410 may be coupled with the trays 420 and the guide unit 430 to form storage space.

According to an example, the tilt body part 410 may include fixing holes 411 at the left and right side portions. The fixing hole 411 of the left side portion may be at the same height as the fixing hole 411 of the right side portion. A plurality of fixing holes 411 may be provided to correspond to the number of the trays 420.

For example, if two or more trays 420 are provided in the tilt guide assembly 400, the fixing holes 411 may be respectively provided in the left and right side portions of the tilt body part 410 at the heights at which the respective trays 420 are positioned.

A rotation adjusting member (also, referred to as a tilt adjusting member) 451 which will be described later may be inserted into the fixing hole 411 so that the tray 420 can be coupled with the tilt body part 410.

The tray 420 may be in the shape of a flat plate having a predetermined thickness. The tray 420 may form storage space in the rear surface of the door 300 together with the tilt body part 410. Food may be put on the tray 420 in the storage space of the rear surface of the door 300. According to an example, a plurality of trays 420 may be provided.

One or more connection holes 421 may be formed in the left and right side portions of the tray 420. The connection holes 421 of the left and right side portions may overlap each other, as seen from the side. Also, the connection holes 421 may be formed at locations overlapping the fixing holes 411 of the tilt body part 410, as seen from the side, when the tray 420 is coupled with the tilt body part 410. According to an example, the connection holes 421 may be formed in the side back portions of the tray 420.

The rotation adjusting member 451 which will be described later may be inserted into the connection hole 421 so that the tray 420 can be coupled with the tilt body part 410.

The guide unit 430 may form the storage space together with the tray 420 and the tilt body part 410. The guide unit 430 may include a front guide part, and a side guide part extending from both ends of the front guide part and bent toward the back area of the storage space. The guide unit 430 may be fixed at the front end of the upper surface of the tray 420 at both sides.

The guide unit 430 may be made of a transparent material so that a user can see food put in the storage space from the outside.

FIG. 26 is a bottom view of the tilt unit 450 disposed in the bottom of the tilt guide assembly 400 of FIG. 24, and FIG. 27 is a cross-sectional view showing the rotation adjusting member 451 of the tilt unit 450 of FIG. 25.

Referring to FIGS. 24 to 27, the tilt unit 450 may include the tilt adjusting member 451, a first tilt catching member 453, a second tilt catching member 455, and a handle member 457. The tilt unit 450 may allow the tray 420 and the guide unit 430 to rotate at a predetermined angle on the tilt adjusting member 451 as an axis.

The tilt adjusting member 451 may include a support part 451*a* and a rotation shaft 451*b*.

The support part 451*a* may be coupled with the bottom of the tray 420 at one side. The support part 451*a* may rotate together with the tray 420, and transfer a rotatory force to the rotation shaft 451*b*.

The rotation shaft 451*b* may be installed at one end of the support part 451*a*. The rotation shaft 451*b* may be coupled with the tilt body part 410 at one end, and coupled with the support part 451*a* at the other end. The rotation shaft 451*b* may be rotatable with respect to the tilt body part 410. The rotation shaft 451*b* may rotate in the state in which it is inserted into the connection hole 421 and the fixing hole 411.

According to an embodiment of the present disclosure, the rotation shaft 451*b* may have a catching groove 451*c*. The catching groove 451*c* may be formed in the shape of a concave groove at one end of the outer side surface of the rotation shaft 451*b*.

According to an embodiment of the present disclosure, the fixing hole 411 may have a rotation adjusting groove 411*a* that is concave towards the inside. The fixing hole 411 may enable the inserted rotation shaft 451*b* to rotate within a predetermined range. More specifically, the fixing hole 411 may be formed in such a way that a part of the catching groove 451*c* of the rotation shaft 451*b* rotating in the inside of the fixing hole 411 is caught by a part of the rotation adjusting groove 411*a*. In this way, an angle to which the rotation shaft 451*b* is inserted into the fixing hole 411 and rotates can be limited.

The first tilt catching member 453 may have a first tilt catching part 453*a* and a tilt guide hole 453*b*. The first tilt catching member 453 may be fixed on the bottom of the tray 420 at one side edge. The first tilt catching part 453*a* may be formed at the back portion of the bottom of the first tilt catching part 453. The first tilt catching part 453*a* may extend vertically downward from the back portion of the first tilt catching member 453. If the tilt guide assembly 400 rotates to reach a position of a predetermined angle, the first tilt catching part 453*a* may contact the bottom of the tilt body part 410. Thereby, the first tilt catching member 453 may limit the rotation of the tilt guide assembly 400.

The tilt guide hole 453*b* may be formed around one end of the first tilt catching member 453. A tilt guide part 455*b* of the second tilt catching member 455 which will be described later may be inserted into the tilt guide hole 453*b* to move forward or backward.

The second tilt catching member 455 may include a second tilt catching part 455*a* and the tilt guide part 455*b*.

The second tilt catching part 455*a* may protrude backward from the second tilt catching member 455. The second tilt catching part 455*a* may protrude backward from the second tilt catching member 455. The second tilt catching part 455*a* may contact the bottom of the tilt body part 410. The second tilt catching part 455*a* may support the bottom of the tilt body part 410 such that the tilt guide assembly 400 does not rotate.

The tilt guide part 455*b* may be disposed in the front portion of the second tilt catching member 455. The tilt guide part 455*b* may extend forward from the front surface of the second tilt catching member 455. There may be provided a plurality of tilt guide parts 455*b*. According to an example, the plurality of tilt guide parts 455*b* may be provided to correspond to the number of the tilt guide holes 453*b*.

In a part or all of the plurality of tilt guide parts 455*b*, a restoring member 456 may be provided. The restoring member 456 may have a section that is greater than that of the tilt guide hole 453*b*. If the second tilt catching member 455 is moved forward by a user, the restoring member 456 may guide the second tilt catching member 455 to again move backward. The restoring member 456 may guide the second tilt catching member 455 to return to a predetermined position. The restoring member 456 may be a spring.

According to an example, the second tilt catching member 455 may move along the tilt guide part 455*b* of the first tilt catching member 453. The second tilt catching member 455 may move forward or backward independently on the bottom of the tray 420. In the second tilt catching member 455, the tilt guide part 455*b* may move forward or backward into the tilt guide hole 453*b* of the fixed first tilt catching member 453. Accordingly, the user may move the second tilt catching member 455 while gripping the handle member 457 which will be described later, thereby rotating the tilt guide assembly 400.

The handle member 457 may be coupled with the second tilt catching member 455. The handle member 457 may be coupled with the front portion of the second tilt catching member 455. According to an example, the handle member 457 may be coupled with the front lower portion of the tilt guide part 455*b*.

The handle member 457 may have a upwardly concave gripping groove 457*a* in the bottom. The user may grip the gripping groove 457*a* of the handle member 457 to move the second tilt catching member 455 forward or backward together with the handle member 457.

Hereinafter, a process in which the tilt guide assembly 400 according to an embodiment of the present disclosure rotates will be described.

FIGS. 28, 29, and 30 are views for describing operation in which the tilt guide assembly 400 of FIG. 24 is rotated by the tilt unit 450.

The tilt guide assembly 400 may enable the tray 420 to rotate. The tray 420 may rotate on the rotation shaft 451*b* of the tilt unit 450 as an axis. The tray 420 may rotate to enable the guide unit 430 to open or close the storage space.

Referring to FIG. 28, when the tray 420 is maintained in a closed state, the second tilt catching part 455*a* may support a bottom 412 of the tilt body part 410. Since the second tilt catching part 455*a* is caught by the bottom 412 of the tilt body part 410, the tray 420 can be prevented from rotating, and the guide unit 430 can be maintained in a closed state.

Referring to FIG. 29, if the user pulls the handle member 457 in the front direction of the tilt guide assembly 400, the second tilt catching member 455 connected to the handle member 457 may move forward. Accordingly, the second tilt catching part 455*a* cannot support the bottom 412 of the tilt body part 410, so that the tray 420 can rotate to open the guide unit 430. In the current embodiment, since the rotation shaft 451*b* is disposed in the back portion of the tray 420, the tray 420 may rotate automatically when the second tilt catching part 455*a* cannot support the bottom 412 of the tilt body part 410.

Referring to FIG. 27, the tray 420 cannot rotate to a greater angle than a predetermined angle. If the tray 420 rotates to reach a position of the predetermined angle, the catching groove 451*c* of the rotation shaft 451*b* may be caught by a part of the rotation adjusting groove 411*a* of the fixing hole 411 to limit the rotation of the tray 420.

Also, referring to FIG. 30, if the tray 420 rotates to reach the position of the predetermined angle, the first tilt catching part 453*a* of the first tilt catching member 453 may be caught by the bottom 412 of the tilt body part 410. In this way, the tray 420 cannot rotate to a greater angle than the predetermined angle.

As such, the tilt guide assembly 400 may be configured so that when the user pulls the handle member 457, the tray 420 rotates to the predetermined angle and then stops.

Also, the user may move the tray 420 and the guide unit 430 to a position at which the storage space is closed. If the user moves the tray 420 and the guide part 430 to a position at which the storage space is closed, the first tilt catching part 453*a* may move backward by the restoring member 456 so that a position at which the bottom 412 of the tilt body part 410 is supported also moves. Thereby, the tray 420 may stop at the position at which the storage space is closed.

Hereinafter, another embodiment of the tilt guide assembly 400 will be described.

FIG. 31 is an exploded perspective view of a tilt guide assembly according to another embodiment of the present disclosure, as seen from above, and FIG. 32 is an exploded perspective view of the tilt guide assembly of FIG. 31, as seen from below.

Referring to FIGS. 31 and 32, a tilt guide assembly 500 according to another embodiment of the present disclosure may include a tilt body part 510, a tray 520, a guide unit 530, and a tilt unit 550.

The tilt body part 510 may be coupled with the rear surface of the door 21. The rear surface of the tilt body part 510 may contact the rear plate 21*b* of the door 21. The tilt body part 510 may be coupled with the tray 520 and the guide unit 530 to form storage space.

According to an example, the tilt body part 510 may include a tray support unit 512. The tray support unit 512 may extend forward from the lower end of the tilt body part 510. The upper surface of the tray support unit 512 may be in the shape of a flat plate.

At a part of the upper surface of the tray support unit 512, a buffer hole 513 may be formed. There may be provided a plurality of buffer holes 513. The buffer hole 513 may provide space into which a buffer member 553 is inserted. According to an example, the buffer hole 513 may include a material having elasticity.

The tray 520 may be in the shape of a flat plate having a predetermined thickness. The tray 520 may form storage space in the rear surface of the door 21 together with the tilt body part 510. Food may be put on the tray 520 in the storage space of the rear surface of the door 21. According to an example, a plurality of trays 420 may be provided.

The guide unit 530 may form the storage space together with the tray 520 and the tilt body part 510. The guide unit 530 may include a front guide part, and a side guide part extending from both ends of the front guide part and bent toward the back area of the storage space. The lower end of the guide unit 530 may be fixed at the front end of the upper surface of the tray 420 at both sides.

The guide unit 530 may be made of a transparent material so that a user can see food put on the storage space from the outside.

The tilt unit 550 may include a tilt rotation shaft 551, a rotation shaft coupling unit 552, a buffer member 553, and a rotation catching part 555.

The tilt rotation shaft 551 may be installed on the bottom of the tray support unit 512. The tilt rotation shaft 551 may be disposed at the front portion of the bottom of the tray support unit 512. Two tile rotation shafts 551 may be provided at symmetrical locations on the tray support unit 512. The tilt rotation shafts 551 may protrude to the left and right of the bottom of the tray support unit 512.

The rotation shaft coupling unit 552 may be disposed at the front portion of the bottom of the tray 520. The rotation shaft coupling unit 552 may be coupled with the tilt rotation shaft 551 to provide space in which the tilt rotation shaft 551 can rotate.

The buffer member 553 may be disposed in the front portion of the bottom of the tray 520. The buffer member 553 may be disposed at a location overlapping the buffer hole 513 disposed in the upper surface of the tray 520, as seen from above. More specifically, when the storage space is maintained in a closed state, the buffer member 553 may be inserted into the buffer member 553. Accordingly, when the storage space is in the closed state, the tray 520 may be maintained in a stationary state.

The rotation catching part 555 may be formed at a part of the front portion of the bottom of the tray support unit 512. One end of the rotation catching part 555 may be coupled with the bottom of the tray support unit 512, and the other end of the rotation catching part 555 may extend downward from the end of the rotation catching part 555 coupled with the bottom of the tray support unit 512. The rotation catching part 555 may control the rotation of the tray 520 such that the tray 520 cannot rotate to a greater angle than a predetermined angle.

Hereinafter, operation in which the tilt guide assembly 500 rotates will be described in detail.

FIGS. 33 and 34 are views for describing operation in which the tilt guide assembly 500 of FIG. 31 is rotated by the tilt unit 550.

The tilt guide assembly 550 may enable the tray 520 to rotate. The tray 520 may rotate on the tilt rotation shaft 551 of the tilt unit 550. The tray 520 may rotate for the guide unit 530 to open or close storage space.

Referring to FIG. 33, when the tray 520 is maintained in a closed state, the buffer unit 553 may be inserted into the buffer hole 513. The buffer unit 553 may be inserted into the buffer hole 513 having elasticity so that the buffer unit 553 does not escape from the buffer hole 513 so long as a user does not apply a predetermined force to the tray 520. Accordingly, the tray 520 can be maintained in a closed state so long as no external force is applied to the tray 520.

Also, since the tilt rotation shaft 551 is disposed in the front portion of the tray 520, the tray 520 cannot rotate automatically when no external force is applied to the tray 520.

Referring to FIG. 34, if the user applies a force to the guide unit 530 or the tray 520, the guide unit 530 and the tray 520 can rotate. If the buffer unit 553 escapes from the buffer hole 513 due to the force applied by the user, the guide unit 530 and the tray 520 can rotate.

If the tray 520 rotates to reach a position of a predetermined angle, the rotation catching part 555 may be caught by the bottom of the front end of the tray 520. Since the tray 520 rotates relatively from the tray support unit 512 on the tilt rotation shaft 551 as an axis, the bottom of the front end of the tray 520 may be caught by the rotation catching part 555 in a stationary state when the tray 520 rotates to reach the position of the predetermined angle. In this way, the rotation of the tray 520 may be limited.

FIG. 35 is a perspective view showing a rotation guide assembly of the refrigerator 1 of FIG. 2, and FIG. 36 is an exploded perspective view of the rotation guide assembly of FIG. 35.

Referring to FIGS. 35 and 36, a rotation guide assembly 600 may include a rotation guide body part 610, a tray 620, a guide unit 630, and a body part rotating unit 650.

The rotation guide assembly 600 may be coupled with the rear plate 21 of the door 21, and located in the inside of the refrigerating chamber 20 when the door 21 closes. The rotation guide assembly 600 may rotate on its one side coupled with the rear plate 21*c* of the door 21.

The rotation guide body part 610 may be coupled with the rear surface of the door 21. The rear surface of the rotation guide body part 610 may contact the rear plate 21*c* of the door 21. According to an example, the rotation guide body part 610 may be coupled with the rear surface of the door 21 to provide space where the mineral water producing apparatus 140 can be located between the rotation guide body part 610 and the rear surface of the door 21.

According to an embodiment of the present disclosure, the rotation guide body part 610 may be coupled with the body part rotating unit 650 at one side. The body part rotating unit 650 may be coupled with the edge portion of the rotation guide body part 610. The rotation guide body part 610 can rotate on the body part rotating unit 650 as an axis.

According to an example, the body part rotating unit 650 may include a rotation unit coupling part 651 and a rotation unit hinge member 653. The rotation unit coupling part 651 may be coupled with one edge of the rotation guide body part 610.

The rotation unit coupling part 651 may have a hinge member coupling hole 651*a*. Two hinge member coupling holes 651*a* may be respectively formed in the upper and lower portions of the rotation unit coupling part 651. The rotation unit hinge member 653 may be inserted into and rotated in the hinge member coupling hole 651*a*.

The rotation unit hinge member 653 may have a rotation unit hinge shaft 653*a*. The rotation unit hinge member 653 may enable the rotation unit hinge shaft 653*a* to penetrate the hinge member coupling hole 651*a* to be coupled with the rotation guide body part 610. The rotation guide body part 610 may rotate on the rotation unit hinge member 653 as an axis. A plurality of rotation unit hinge members 653 may be provided to correspond to the number of the hinge member coupling holes 651*a*.

The body part rotation unit 650 may further include a door open switch 655. The door open switch 655 may be disposed in one side portion of the rotation guide body part 610. A user may manipulate the door open switch 655 to cause the rotation guide body part 610 to be fixed on the rear surface of the door or to be rotated from the rear surface of the door 21. More specifically, the door open switch 655 may fix the rotation guide body part 610 on the rear surface of the door so that the rotation guide body part 610 can be maintained in a closed state. Also, when the user rotates the rotation guide assembly 600, the door open switch 655 may cause the rotation guide body part 610 to release from the rear surface of the door.

FIG. 37 is a view for describing operation in which the rotation guide assembly 600 of FIG. 35 rotates.

Referring to FIG. 37, the rotation guide body part 610 may rotate on the rotation unit hinge member 653 as an axis.

According to an example, the rotation guide assembly 600 may be disposed on the rear surface of the door in which a dispenser (not shown) is installed. In a refrigerator of producing mineral water, a mineral water producing apparatus may be installed on the rear surface of the door in which a dispenser (not shown) is installed. In the mineral water producing apparatus, a container in which carbon dioxide is stored may need to be periodically replaced with new one. Accordingly, in the refrigerator 1 according to an embodiment of the present disclosure, the mineral water producing apparatus and the rotation guide assembly 600 may be provided on the rear surface of the door in which the dispenser (not shown) is installed. The mineral water producing apparatus may be positioned between the rear surface of the door 21 and the rotation guide assembly 600. Accordingly, when a container in which carbon dioxide is stored is replaced with new one in the mineral water producing apparatus, a user may rotate the rotation guide assembly 600 to perform a work related to the rotation guide assembly 600.

The above description relates to an example in which the rotation guide assembly 600 is installed in the door in which the dispenser is installed. However, the rotation guide assembly 600 may be installed in any other door in which the dispenser is installed or not installed.

Meanwhile, the technical concept of the present disclosure can be applied to all kinds of refrigerators.

It will be apparent to those skilled in the art that various modifications and variations can be made in the present disclosure without departing from the spirit or scope of the inventions. Thus, it is intended that the present disclosure covers the modifications and variations of this invention provided they come within the scope of the appended claims and their equivalents.

The invention claimed is:

1. A refrigerator comprising:

a main body;

a storage room inside the main body;

a first door including a front plate which is made of a steel material and in which a plurality of through holes are arranged to form a predetermined shape, two or more of the plurality of through holes being arranged to form the predetermined shape which includes at least one of a picture, a letter, a figure, and a symbol to supply information to a user, the first door configured to open or close the storage room, the first door having an interior;

a second door including a cap made of a material different from the front plate of the first door:

a display disposed in the interior of the first door, and including a light source and configured to display a shape through the plurality of through holes and to face the plurality of through holes, the display comprising:

a display cover installed in a rear surface of the front plate, and configured to form accommodation space for accommodating the display behind the plurality of through holes, a front cover positioned between the display and a rear surface of the front plate, the front cover having a plurality of connection holes corresponding to the plurality of through holes; and a user input separated from the display, and configured to receive an operation command for operating the refrigerator, the user input being disposed in the cap of the second door, the user input including a sensor configured to measure a change in charges according to a user's touch input.

2. The refrigerator according to claim 1, wherein the first door further comprises an upper cap forming an upper surface of the first door, the upper cap having an inlet hole through which the display enters the accommodation space.

3. The refrigerator according to claim 1, wherein the display cover has an open front part so that light emitted from the display is irradiated towards the plurality of through holes.

4. The refrigerator according to claim 1, wherein the front cover includes a cover guide having an upper portion and a lower portion, and the cover guide guides the display so that the display is closer to the front cover at the lower portion of the cover guide than at the upper portion of the cover guide.

5. The refrigerator according to claim 1, wherein the front cover is rounded and wherein the front plate is rounded to protrude forward so that a front surface of the front cover has a shape corresponding to the front plate.

6. The refrigerator according to claim 1, further comprising:

a controller configured to control the refrigerator according to the operation command received from the user input, the controller being located outside the first door; and a connection configured to transfer an electrical signal for the operation command generated by the user input to the controller, wherein the connection is connected to the controller located outside the first door through a hinge coupled with the second door in which the user input is disposed.

7. A refrigerator comprising:

a main body;

a storage room formed in the inside of the main body;

a first door configured to open or close the storage room, and having a front part in which a plurality of through holes are arranged to form a predetermined shape, two or more of the plurality of through holes being arranged to form the predetermined shape which includes at least one of a picture, a letter, a figure, and a symbol, to supply information to a user, the first door having an interior;

a second door including a cap made of a material different from the front plate of the first door;

a display disposed behind the plurality of through holes in the interior of the first door, and including a light source and configured to display refrigerator information; and a user input configured to receive an operation command for operating the refrigerator, the user input being disposed in the cap of the second door, the user input including a sensor configured to measure a change in charges according to a user's touch input, wherein the display further comprises a display cover installed in the inside of the first door to form accommodation space in which the display is disposed, and a front cover positioned between the display and a rear surface of the front part, the front cover having a plurality of connection holes corresponding to the plurality of through holes.

8. The refrigerator according to claim 7, wherein the display cover has an open front part, and forms the accommodation space behind the plurality of through holes.

9. The refrigerator according to claim 7, wherein the first door comprises:

a front plate made of steel material and forming front and side surfaces of the first door, the front plate having the front part in which the plurality of through holes are arranged;

a rear plate coupled with a rear part of the front plate, and forming a rear surface of the first door;

an upper cap coupled with an upper part of the front plate; and a lower cap coupled with a lower part of the front plate.

10. The refrigerator according to claim 9, wherein the front plate is rounded to protrude forward.

11. The refrigerator according to claim 9, wherein the front cover has a front part corresponding to the front plate.

12. The refrigerator according to claim 9, wherein the front cover includes a cover guide having an upper portion and a lower portion, and the cover guide guides the display so that the display is closer to the front cover at the lower portion of the cover guide than at the upper portion of the cover guide.

13. The refrigerator according to claim 7, further comprising:

a controller configured to control the refrigerator according to the operation command received from the user input; and a connection configured to transfer an electrical signal for the operation command generated by the user input to the controller, wherein the connection is connected to the controller located outside the first door through a hinge coupled with the second door in which the user input is disposed.

* * * * *